US006995680B2

(12) United States Patent
Fong

(10) Patent No.: US 6,995,680 B2
(45) **Date of Patent: *Feb. 7, 2006**

(54) LEVEL/POSITION SENSOR AND RELATED ELECTRONIC CIRCUITRY FOR INTERACTIVE TOY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 188 days.

This patent is subject to a terminal disclaimer.

(21) Appl. No.: 10/628,007

(22) Filed: Jul. 25, 2003

(65) Prior Publication Data

US 2004/0075571 A1 Apr. 22, 2004

Related U.S. Application Data

(63) Continuation-in-part of application No. 10/179,569, filed on Jun. 25, 2002, which is a continuation of application No. 09/568,900, filed on May 11, 2000, now Pat. No. 6,437,703, which is a continuation-in-part of application No. 09/478,388, filed on Jan. 6, 2000, now Pat. No. 6,377,187.

(60) Provisional application No. 60/398,372, filed on Jul. 25, 2002.

(51) Int. Cl.
*G08B 21/00* (2006.01)

(52) U.S. Cl. ..... 340/686.1; 340/689; 340/573.1; 340/691.2; 200/52 R; 200/61.45 R; 200/61.52; 73/652; 73/654

(58) Field of Classification Search ..... 340/689, 340/686.1, 573.1, 691.2; 200/61.48, 52 R, 200/61.45 R, 61.52; 73/652, 654, 651, 653, 73/657, 655, 649; 434/311
See application file for complete search history.

(56) References Cited

U.S. PATENT DOCUMENTS

| | | | | |
|---|---|---|---|---|
| 3,601,729 A | | 8/1971 | Hierta | |
| 4,321,438 A | | 3/1982 | Emenegger | |
| 4,339,747 A | | 7/1982 | Maybee | |
| 4,390,928 A | | 6/1983 | Runge | |
| 4,503,299 A | | 3/1985 | Henrard | |
| 4,651,613 A | * | 3/1987 | Harrison | 84/95.2 |
| 4,803,342 A | | 2/1989 | Steers et al. | |
| 4,866,850 A | | 9/1989 | Kelly et al. | |

(Continued)

*Primary Examiner*—Anh V. La
(74) *Attorney, Agent, or Firm*—Stetina Brunda Garred & Brucker

(57) ABSTRACT

A sensor for use in an interactive electronic device. The sensor comprises a housing having a side wall defining an inner surface, a top plate attached to the side wall and defining an inner surface, and a bottom plate attached to the side wall and also defining an inner surface. The inner surfaces of the side wall and the top and bottom plates collectively define an interior chamber. Disposed on the inner surface of the top plate is at least one top conductive pad, while disposed on the inner surface of the bottom plate is at least one bottom conductor pad. At least one switch partially extends into the interior chamber of the housing. Disposed within the interior chamber and rotatably connected to the housing is a trigger mechanism. The sensor is operative to generate a plurality of different conditions or states corresponding to respective positions of the housing relative to a reference plane. The conditions are generated by the movement of the housing relative to the reference plane, and the resultant contact between the trigger mechanism and at least one of the top conductive pad, the bottom conductive pad, and the switch.

20 Claims, 20 Drawing Sheets

U.S. PATENT DOCUMENTS

| | | | | |
|---|---|---|---|---|
| 4,925,189 | A | 5/1990 | Braeunig | |
| 5,001,466 | A | 3/1991 | Orlinsky et al. | |
| 5,130,693 | A | 7/1992 | Gigandet | |
| 5,168,264 | A | 12/1992 | Agustin | |
| 5,195,746 | A | 3/1993 | Boyd et al. | |
| 5,209,343 | A | 5/1993 | Romano | |
| 5,290,198 | A * | 3/1994 | Nakayama | 446/297 |
| 5,300,921 | A | 4/1994 | Hoch et al. | |
| 5,402,107 | A | 3/1995 | Rencavage | |
| 5,450,049 | A | 9/1995 | Bachmann | |
| 5,610,338 | A | 3/1997 | Kato et al. | |
| 5,694,340 | A | 12/1997 | Kim | |
| 5,703,567 | A | 12/1997 | Cleveland | |
| 5,992,849 | A | 11/1999 | Olti et al. | |
| 6,106,398 | A | 8/2000 | Davis | |
| 6,157,898 | A | 12/2000 | Marinelli | |
| 6,215,978 | B1 * | 4/2001 | Ruzic et al. | 434/311 |
| 6,340,980 | B1 * | 1/2002 | Ho | 345/776 |
| 6,377,187 | B1 | 4/2002 | Fong | |
| 6,437,703 | B1 * | 8/2002 | Fong | 340/689 |

* cited by examiner

LEVEL/POSITION SENSOR AND RELATED ELECTRONIC CIRCUITRY FOR INTERACTIVE TOY

CROSS-REFERENCE TO RELATED APPLICATIONS

The present application is a continuation-in-part of U.S. application Ser. No. 10/179,569 entitled LEVEL/POSITION SENSOR AND RELATED ELECTRONIC CIRCUITRY FOR INTERACTIVE TOY filed Jun. 25, 2002, which is a continuation of U.S. application Ser. No. 09/568,900 entitled LEVEL/POSITION SENSOR AND RELATED ELECTRONIC CIRCUITRY FOR INTERACTIVE TOY filed May 11, 2000 and issued as U.S. Pat. No. 6,437,703 on Aug. 20, 2002, which is a continuation-in-part of U.S. application Ser. No. 09/478,388 entitled LEVEL/POSITION SENSOR AND RELATED ELECTRONIC CIRCUITRY FOR INTERACTIVE TOY filed Jan. 6, 2000 and issued as U.S. Pat. No. 6,377,187 on Apr. 23, 2002, and claims priority to U.S. Provisional Application Ser. No. 60/398,372 entitled LEVEL/POSITION SENSOR AND RELATED ELECTRONIC CIRCUITRY FOR INTERACTIVE TOY filed Jul. 25, 2002, the disclosures of which are incorporated herein by reference.

STATEMENT RE: FEDERALLY SPONSORED RESEARCH/DEVELOPMENT (Not Applicable)

BACKGROUND OF THE INVENTION

The present application relates generally to interactive electronic toys, and more particularly to a uniquely configured sensor and associated electronic circuitry which may be incorporated into interactive electronic toys and games (including dolls and remote controllers such as joysticks) and is operative to produce various visual and/or audible outputs or signal transmissions corresponding to the level/position of the toy relative to a prescribed plane.

There is currently known in the prior art a multitude of interactive electronic toys which are capable of producing a wide variety of visual and/or audible outputs. In the prior art toys, these outputs are typically triggered as a result of the user (e.g., a child) actuating one or more switches of the toy. The switch(es) of the prior art toys are most typically actuated by pressing one or more buttons on the toy, opening and/or closing a door or a hatch, turning a knob or handle, inserting an object into a complementary receptacle, etc. In certain prior art interactive electronic toys, the actuation of the switch is facilitated by a specific type of movement of the toy. However, in those prior art electronic toys including a motion actuated switch, such switch is typically capable of generating only a single output signal as a result of the movement of the toy.

The present invention provides a uniquely configured sensor and associated electronic circuitry which is particularly suited for use in interactive electronic toys and games, including dolls and remote controllers such as joysticks. The present sensor is specifically configured to generate a multiplicity of different output signals which are a function of (i.e., correspond to) the level/position of the toy relative to a prescribed plane. Thus, interactive electronic toys and games incorporating the sensor and associated electronic circuitry of the present invention are far superior to those known in the prior art since a wide variety of differing visual and/or audible outputs and/or various signal transmissions may be produced simply by varying or altering the level/position of the toy relative to a prescribed plane. For example, the incorporation of the sensor and electronic circuitry of the present invention into an interactive electronic toy such as a spaceship allows for the production of differing visual and/or audible outputs as a result of the spaceship being tilted in a nose-up direction, tilted in a nose-down direction, banked to the left, banked to the right, and turned upside down. As indicated above, the output signals generated by the sensor differ according to the level/position of the sensor relative to a prescribed plane, with the associated electronic circuitry of the present invention being operative to facilitate the production of various visual and/or audible outputs corresponding to the particular output signals generated by the sensor.

If incorporated into a joystick or other remote controller, the present sensor and associated electronic circuitry may be configured to facilitate the production of the aforementioned visual and/or audible outputs, and/or generate electrical/electronic signals, radio signals, infrared signals, microwave signals, or combinations thereof which may be transmitted to another device to facilitate the control and operation thereof in a desired manner. The frequency and/or coding of the radio, microwave, or electrical/electronic signals and the coding of the infrared signals transmitted from the joystick or other remote controller would be variable depending upon the level or position of the same relative to a prescribed plane. Moreover, the present electronic circuitry may be specifically programmed to memorize or recognize a prescribed sequence of movements of the sensor relative to a prescribed plane. More particularly, a prescribed sequence of states or output signals generated by the sensor corresponding to a prescribed sequence of movements thereof, when transmitted to the electronic circuitry, may be used to access a memory location in the electronic circuitry in a manner triggering or implementing one or more pre-programmed visual and/or audible functions or effects and/or the transmission of various electrical (hard wired), infrared, radio, or microwave signals to another device for communication and/or activation of various functions thereof. These, and other unique attributes of the present invention, will be discussed in more detail below.

BRIEF SUMMARY OF THE INVENTION

In accordance with the present invention, there is provided a uniquely configured sensor which is operative to generate or produce a multiplicity of different states or conditions corresponding to respective positions of the sensor relative to a reference plane. The movement of the sensor relative to the reference plane facilitates the rotation of a trigger mechanism of the sensor which in turn results in the generation of the differing conditions corresponding to the particular nature of the electrical contact between the trigger mechanism and various switches and conductive pads of the sensor.

BRIEF DESCRIPTION OF THE DRAWINGS

These, as well as other features of the present invention, will become more apparent upon reference to the drawings wherein.

DETAILED DESCRIPTION OF THE INVENTION

Figure 2:
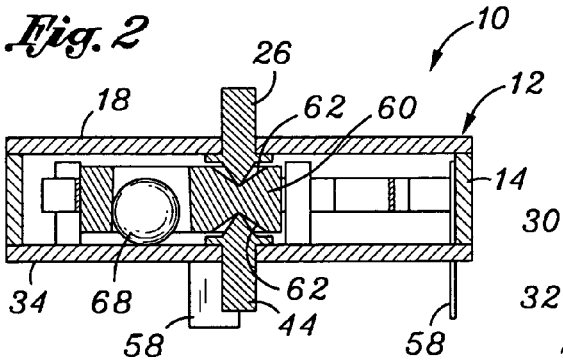
FIG. 2 is a cross-sectional view of the sensor of the first embodiment.
Figure 3:
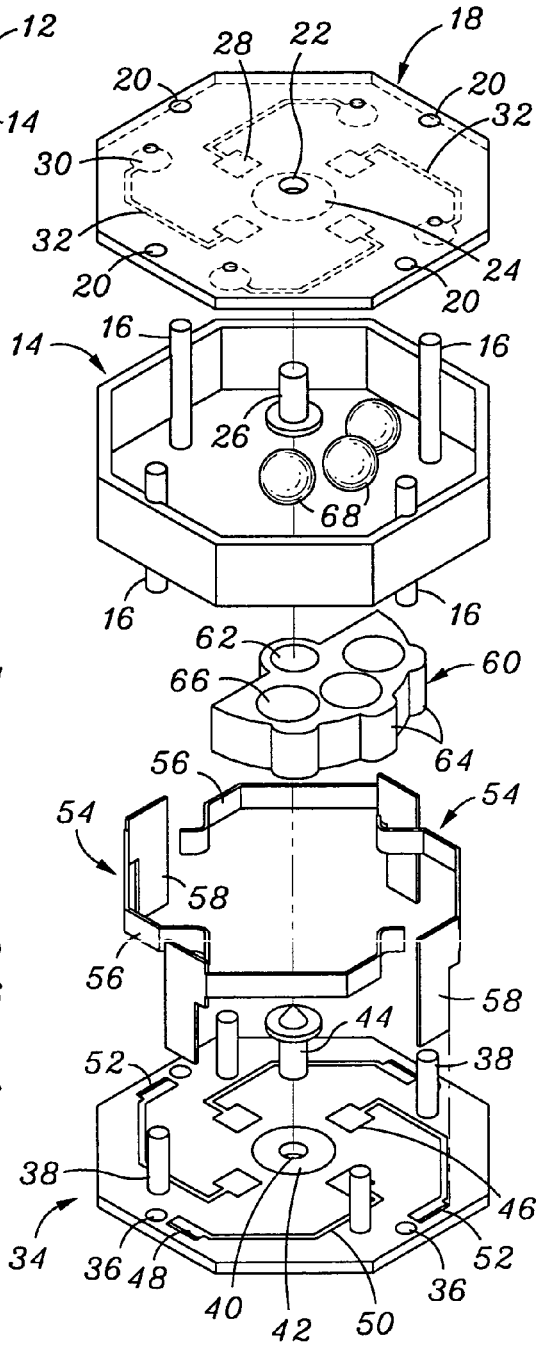
FIG. 3 is an exploded view of the sensor of the first embodiment.
Figure 1:
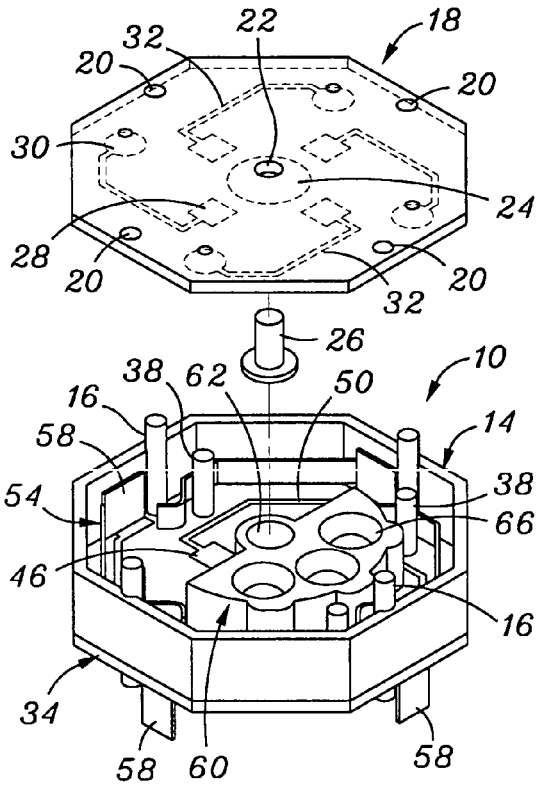
FIG. 1 is a top perspective view of a sensor constructed in accordance with a first embodiment of the present invention, illustrating the top plate as separated from the remainder thereof.

Referring now to the drawings wherein the showings are for purposes of illustrating preferred embodiments of the present invention only, and not for purposes of limiting the same, FIGS. 1–3 illustrate sensor 10 constructed in accordance with a first embodiment of the present invention. The sensor 10 comprises a housing 12. The housing 12 itself comprises an octagonally shaped side wall 14 which defines top and bottom peripheral rims, and includes four cylindrically configured post portions 16 integrally connected to respective ones of four side wall segments thereof. The post portions 16 are sized relative to the remainder of the side wall 14 so as to protrude beyond the top and bottom peripheral rims thereof.

In addition to the side wall 14, the housing 12 comprises an octagonally shaped top plate 18 which is attached to the side wall 14 in a manner wherein a peripheral portion of the inner surface of the top plate 18 abuts the top peripheral rim of the side wall 14. To maintain a proper registry between the side wall 14 and the top plate 18, disposed within the top plate 18 are four apertures 20 which are sized and configured to receive respective ones of the post portions 16 of the side wall 14. When the top plate 18 is properly secured to the side wall 14, the peripheral edge of the top plate 18 is substantially flush with the outer surface of the side wall 14. Disposed in the approximate center of the top plate 18 is an aperture 22. Additionally, disposed in the approximate center of the inner surface of the top plate 18 is a circularly configured conductive pad 24. The aperture 22 is concentrically positioned within the conductive pad 24. The aperture 22 is sized and configured to receive a top pin 26 of the sensor 10. As seen in FIG. 2, the top pin 26 includes a radially extending flange portion which is abutted against the conductive pad 24 when the top pin 26 is fully inserted in to the aperture 22. The top pin 26 further defines a pointed inner end, and is preferably fabricated from a conductive metal material.

In addition to the pad 24, also disposed on the inner surface of the top plate 18 are four generally square conductive top inner pads 28 which are separated from each other at intervals of approximately ninety degrees. Also disposed on the inner surface of the top plate 18 are four circularly configured conductive top outer pads 30. Each of the top inner pads 28 is electrically connected to a respective one of the top outer pads 30 via a conductive trace 32 which extends therebetween. The pads 24, 28, 30 and traces 32 are preferably formed of very thin copper via conventional etching techniques. As such, the top plate 18 is preferably fabricated from a conventional printed circuit board (PCB) material.

The housing 12 of the sensor 10 further comprises an octagonally shaped bottom plate 34 which is attached to the side wall 14 such that a peripheral portion of the inner surface of the bottom plate 34 abuts the bottom peripheral rim of the side wall 14. To maintain proper registry between the side wall 14 and bottom plate 34, disposed within the bottom plate 34 are four apertures 36 which are adapted to receive respective ones of the post portions 16 of the side wall 14, and in particular those portions of the post portions 16 which protrude beyond the bottom peripheral rim of the side wall 14. Extending perpendicularly from the inner surface of the bottom plate 34 are four cylindrically configured bosses 38, the use of which will be discussed in more detail below.

Disposed within the approximate center of the bottom plate 34 is an aperture 40. Similar to the top plate 18, disposed in the approximate center of the inner surface of the bottom plate 34 is a circularly configured conductive pad 42. The aperture 40 is concentrically positioned within the conductive pad 42, and is sized and configured to receive a bottom pin 44 which is identically configured to the top pin 26. In this respect, the bottom pin 44 is preferably fabricated from a conductive metal material, and includes a radially extending flange portion which is abutted against the pad 42 when the bottom pin 44 is fully inserted into the aperture 40. Additionally, like the top pin 26, the bottom pin 44 defines a pointed inner end.

In addition to the pad 42, disposed on the inner surface of the bottom plate 34 are four generally square conductive bottom inner pads 46 which are equidistantly spaced from each other at intervals of approximately ninety degrees. Also disposed on the inner surface of the bottom plate 34 are four rectangularly configured bottom outer pads 48. Each of the bottom inner pads 46 is electrically connected to a respective one of the bottom outer pads 48 via a conductive trace 50. The bottom outer pads 48 are disposed adjacent to and extend along respective ones of four elongate slots 52 disposed within the bottom plate 34. The pads 42, 46, 48 are themselves preferably formed from very thin copper via conventional etching techniques. Additionally, like the top plate 18, the bottom plate 34 is preferably fabricated from a conventional printed circuit board material.

Figure 4A:
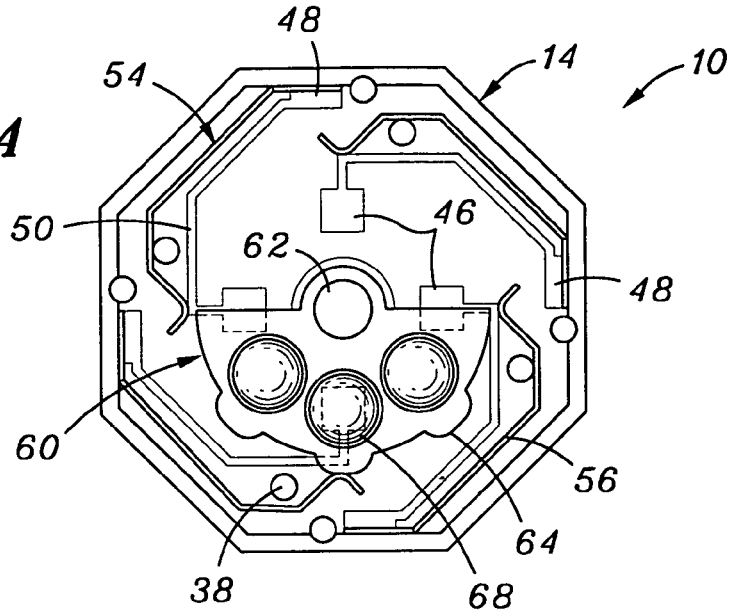
FIGS. 4A, 4B, 4C are top plan views of the sensor of the first embodiment not including the top plate, illustrating the manner in which the switches and contact plates of the sensor are individually or simultaneously actuated by the trigger mechanism of the sensor.
Figure 4B:
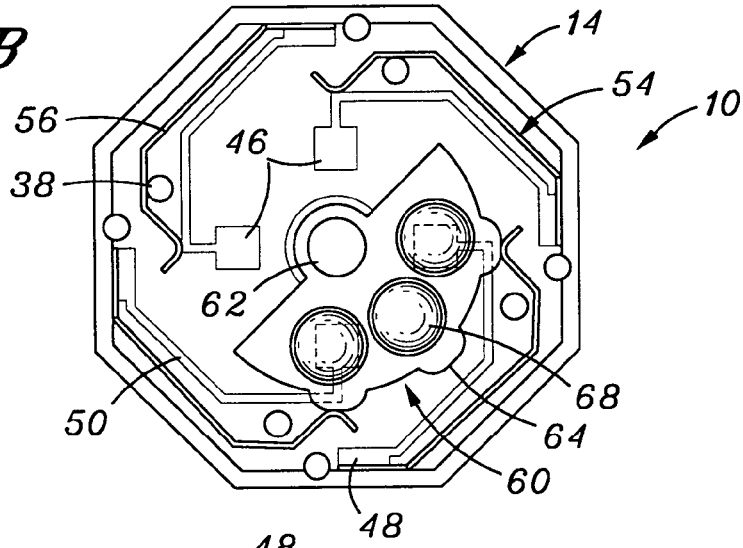
Figure 4C:
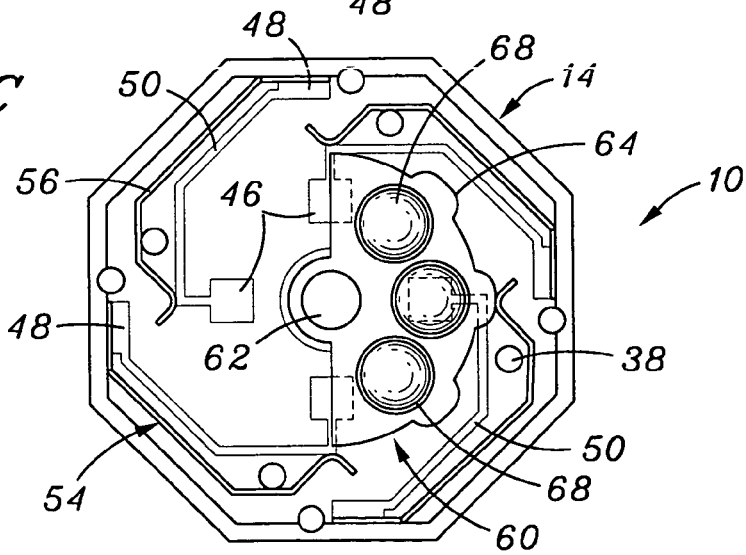

The sensor 10 of the first embodiment further comprises four identically configured switches 54 which are each preferably fabricated from a conductive metal material. Each of the switches 54 preferably comprises a resilient, flexible lead portion 56. In addition to the lead portion 45, each of the switches 54 includes a mount portion 58 which is integrally connected to one end of the lead portion 56. The mount portions 58 are sized and configured to be insertable into respective ones of the slots 52 within the bottom plate 34 so as to protrude from the outer surface thereof in the manner shown in FIGS. 1 and 2. The lead portions 56 are configured such that when the mount portions 58 are inserted into the bottom plate 34, the distal ends of the lead portions 56 will be separated from each other by intervals of approximately ninety degrees, as best seen in FIGS. 4A, 4B, and 4C. When the mount portions 58 of the switches 54 are advanced into respective ones of the slots 52, portions of the switches 54 abut and are thus in conductive contact with respective ones of the bottom outer pads 48 of the bottom plate 34. This conductive contact results in the lead portions 56 of the switches 54 being electrically connected to respective ones of the bottom inner pads 46 via respective ones of the bottom outer pads 48 and traces 50.

The housing 12 of the sensor 10 is assembled by attaching the top and bottom plates 18, 34 to the side wall 14 in the above-described manner. Upon such assembly, the inner surfaces of the top and bottom plates 18, 34 and inner surface of the side wall 14 collectively define an interior cavity or chamber of the housing 12. The lead portions 56 of the switches 54 are disposed within such interior chamber. The bosses 38 of the bottom plate 34 are adapted to act against respective ones of the lead portions 56 in a manner maintaining the same at prescribed orientations within the interior chamber of the housing 12. The distal end of each lead portion 56 is preferably configured to protrude radially inwardly within the interior chamber beyond the corresponding boss 38. As seen in FIGS. 4A, 4B, an 4C, each of the bottom inner pads 46 and top inner pads 28 is disposed between the coaxially aligned axes of the top and bottom pins 26, 44 and a respective one of the distal ends of the lead portions 56 of the switches 54.

The sensor 10 of the first embodiment further comprises a trigger plate 60 which is rotatably connected to the housing 12 and is disposed within the interior chamber defined thereby. The trigger plate 60 has a generally semi-circular shape, and is preferably fabricated from a conductive metal material. Disposed within the opposed top and bottom surfaces of the trigger plate 60 is a coaxially aligned pair of recesses 62 which are used to facilitate the rotatable connection of the trigger plate 60 to the housing 12. More particularly, as seen in FIG. 2, the pointed inner ends of the top and bottom pins 26, 44 are advanced into respective ones of the recesses 62 and engaged to the trigger plate 60. When the housing 12 is assembled in the above-described manner, the apertures 22, 40 within the top and bottom plates 18, 34 are coaxially aligned with each other, thus resulting in the inner ends of the top and bottom pins 26, 44 being coaxially aligned as well. The engagement of the inner ends of the top and bottom pins 26, 44 to the trigger plate 60 allows the trigger plate 60 to be freely rotatable within the interior chamber of the housing 12, yet prevented from upward or downward or side-to-side movement therewithin.

Though not shown, it will be recognized that the rotatable connection of the trigger plate 60 to the housing 12 may be facilitated by providing the trigger plate 60 with a pair of posts which protrude axially from the opposed top and bottom surfaces thereof at the same locations as the recesses 62. The top and bottom pins 26, 44 could alternatively be provided with recesses in place of the pointed inner ends, with the posts of the trigger plate 60 being received into respective ones of the recesses of the top and bottom pins 26, 44.

As seen in FIG. 2, portions of the top and bottom pins 26, 44 protrude from respective ones of the top and bottom plates 18, 34. Additionally, the pointed inner ends of the top and bottom pins 26, 44 loosely engage the trigger plate 60. Importantly, the preferred fabrication of the trigger plate 60 and top and bottom pins 26, 44 from a conductive metal material and the abutment (i.e., conductive contact) between the flange portions of the top and bottom pins 26, 44 and respective ones of the pads 24, 42 facilitates the placement of the trigger plate 60 into electrical communication with the pads 24, 42 via the top and bottom pins 26, 44.

The trigger plate 60 of the sensor 10 defines an arcuate outer surface portion which, due to the shape of the trigger plate 60, extends about one hundred eighty degrees. Formed on and extending radially outward from the outer surface portion are three identically sized and configured protuberances 64 which are spaced from each other and the opposed ends of the outer surface portion at intervals of approximately forty-five degrees. Additionally, disposed within the trigger plate 60 are three identically sized apertures 66 which are disposed adjacent respective ones of the protuberances 64, and are spaced from each other at intervals of approximately forty-five degrees. Disposed within each of the apertures 66 is a spherically shaped trigger ball 68. As best seen in FIG. 2, the diameter of each trigger ball 68 is less than the diameter of each aperture 60, thus allowing each trigger ball 68 to be freely movable and rotatable within its corresponding aperture 66. Each of the trigger balls 68 is also preferably fabricated from a conductive metal material. The trigger plate 60 and trigger balls 68 collectively define a trigger mechanism of the sensor 10.

As best seen in FIG. 2, when the trigger mechanism (i.e., the trigger plate 60 and trigger balls 68) of the sensor 10 is rotatably mounted within the interior chamber of the housing 12 in the above-described manner, the orientation of the apertures 66 and hence the trigger balls 68 within the trigger plate 60 allows each of the trigger balls 68 to be passable over or positionable upon any one of the bottom inner pads 46 of the bottom plate 34 or top inner pads 28 of the top plate 18. More particularly, when the sensor 10 is oriented relative to a generally horizontal reference plane such that the bottom plate 34 is disposed closer to the reference plane than the top plate 18, the trigger balls 68 will move or shift within the apertures 66 such that portions thereof will protrude from the bottom surface of the trigger plate 60 and directly contact the inner surface of the bottom plate 34. Conversely, if the sensor 10 is flipped over such that the top plate 18 is disposed closer to the reference plane than the bottom plate 34, the trigger balls 68 will move or shift within the apertures 66 such that portions thereof protrude from the top surface of the trigger plate 60 and directly contact the inner surface of the top plate 18. As indicated above, due to the orientations of the apertures 66 and the top and bottom inner pads 28, 46 relative to each other, each trigger ball 68 may be passed over or rested upon any one of the top and bottom inner pads 28, 46 relative to each other, each trigger ball 68 may be passed over or rested upon any one of the top and bottom inner pads 28, 46 depending on the orientation of the sensor 10 relative to the reference plane and resultant rotation of the trigger mechanism within the interior chamber of the housing 12.

Referring now to FIGS. 4A, 4B and 4C, the sensor 10 of the first embodiment has the capability of generating or producing a multiplicity of different states corresponding to respective positions of the sensor 10 relative to the reference plane. The movement of the sensor 10 relative to the reference plane facilitates the rotation of the trigger mechanism within the interior chamber of the housing 12. The sensor 10 is operative to generate a low state when the protuberances 64 of the trigger plate 60 are not in contact with any of the switches 54 (i.e., the distal ends of the lead portions 56) and the trigger balls 68 are not in contact with any of the bottom inner pads 46 or top inner pads 28. Though not shown, it will be appreciated from FIGS. 4A, 4B and 4C that when the protuberances 64 are not in contact with any of the switches 54, the distal end of one of the lead portions 56 will extend between an adjacent pair of protuberances 64, but will not be in contact with the outer surface portion of the trigger plate 60. The sensor 10 is further operative to generate four different high states corresponding to contact between the center protuberance 64 and respective ones of the switches 54 (examples of which are shown in FIGS. 4A and 4C), and four additional high states corresponding to the outer pair of protuberances 64 being in simultaneous contact with any pair of the distal ends of the lead portions 56 of the switches 54 separated by a ninety degree interval (an example of which is shown in FIG. 4B).

When any protuberances 64 of the trigger plate 60 moves into contact with the distal end of the lead portion 56 of a switch 54, the protuberance 64 acts against such lead portion 56 in a manner facilitating a slight amount of flexion thereof, which establishes firm contact between such lead portion 56 and the corresponding protuberance 64. Upon such contact, a closed circuit condition is created since there is a complete conductive path comprising one or both of the top and bottom pins 26, 44, the trigger plate 60 (including the protuberances 64), and one or two of the switches 54 (including the lead and mount portions 56, 58). The particular high state generated by the sensor 10 is dependent upon the switch 54 with which electrical contact is established by the center protuberance 64, i.e., each switch 54 produces a different high state when contacted by the center protuberance 64. When the trigger plate 60 is positioned within the interior chamber of the housing 12 such that the outer pair of protuberances 64 simultaneously contact a corresponding pair of switches 54, the particular high state generated by this sensor 10 is dependent upon the combination of switches 54 with which electrical contact is established, i.e., a different high state is produced when any adjacent pair of switches 54 are simultaneously contacted by the outer pair of protuberances 64.

As indicated above, in the sensor 10, each of the switches 54 is in conductive contact with a respective one of the bottom outer pads 48 due to the advancement of the mount portions 58 of the switches 54 into respective ones of the slots 52. Since each of the bottom inner pads 46 is electrically connected to a respective bottom outer pad 48 via a corresponding trace 50, each bottom inner pad 46 is thus electrically connected to a respective switch 54, and more particularly the mount portion 58 thereof. As such, the bottom inner pads 46 of the bottom plate 34 provide failsafe redundancy to the switches 54. In this respect, in the event any lead portion 56 bends or warps such that conductive contact is not achieved between the same and the protuberances 64 upon the rotation of the trigger plate 60, a closed circuit condition is still created since there is a complete conductive path comprising one or both of the top and bottom pins 26, 44, the trigger plate 60, one or two of the trigger balls 68, one or two of the bottom inner pads 46, one or two of the conductive traces 50, one or two of the bottom outer pads 48, and one or two of the switches 54. Thus, each bottom inner pad 46, when contacted by the center trigger ball 68, produces the same high state as the adjacent switch 54 when contacted by the center protuberance 64. Similarly, the high state generated by the sensor 10 when any adjacent pair of the bottom inner pads 46 are simultaneously contacted by respective ones of the outer pair of trigger balls 68 is identical to the high state generated when the corresponding switches 54 are simultaneously contacted by the outer pair of protuberances 64.

As indicted above, if the sensor 10 is oriented such that the top plate 18 is disposed closer to the reference plane than the bottom plate 34, the trigger balls 68 will move or shift within the apertures 66 such that portions thereof protrude from the top surface of the trigger plate 60 and directly contact the inner surface of the top plate 18. The sensor 10 is further operative to generate four different high states (differing from the high states discussed above) corresponding to contact between the center trigger ball 68 and respective ones of the top inner pads 28, and four additional high states corresponding to the outer pair of trigger balls 68 being in simultaneous contact with any adjacent pair of the top inner pads 28 separated by a ninety degree interval. A closed circuit condition is created by the complete conductive path comprising one or both of the top and bottom pins 26, 44, the trigger plate 60, one or two of the conductive traces 32, and one or two of the top outer pads 30. Thus, the sensor 10 has the capability of generating the low state and a totality of sixteen different high states. As will be discussed in more detail below, the high states generated as a result of one or more of the trigger balls 68 being in contact with one or more of the top inner pads 28 are indicative of the sensor 10 being generally upside down, i.e., the top plate 18 being disposed closer to the reference plane than the bottom plate 34.

Figure 26:
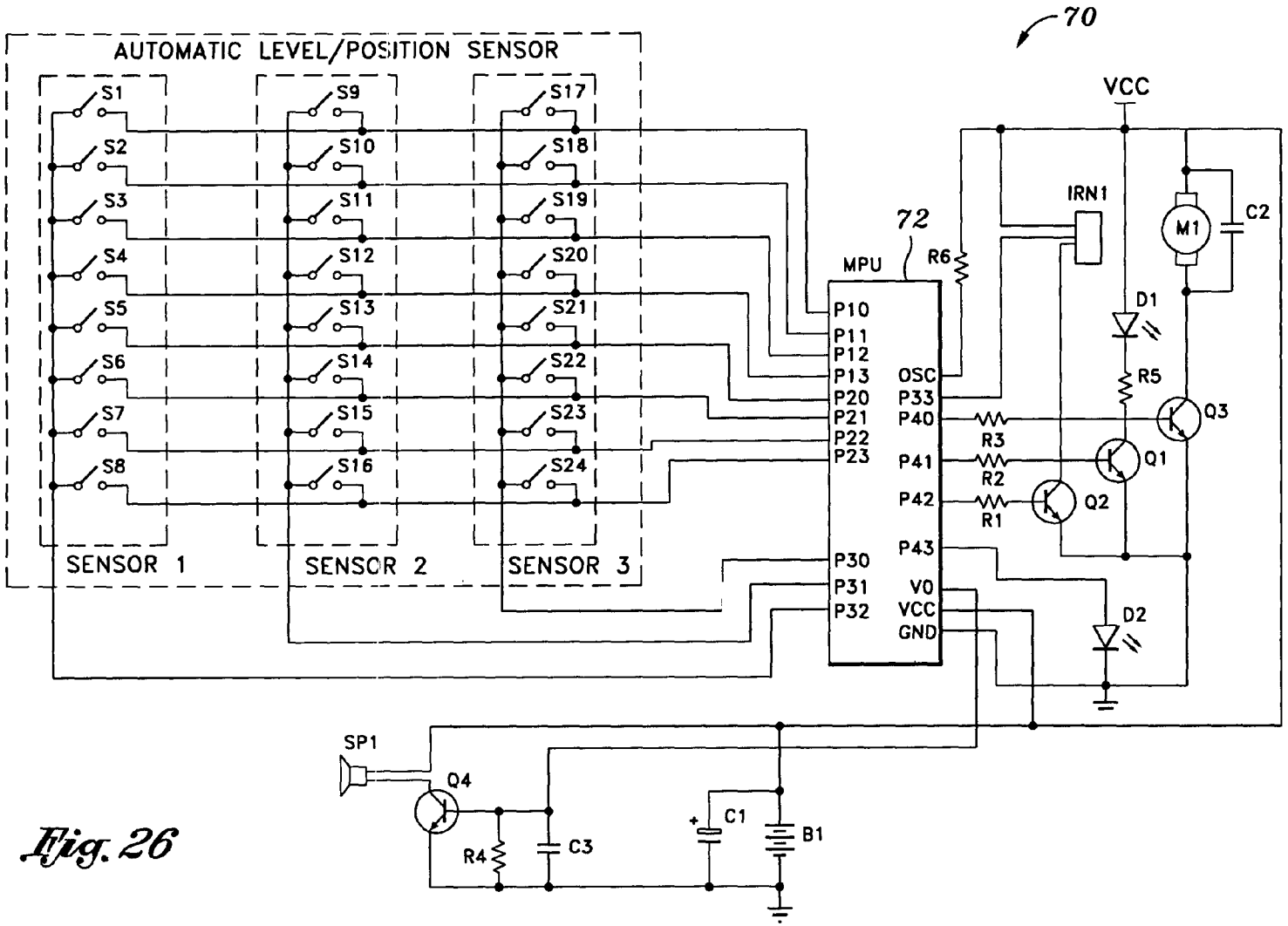
FIG. 26 is a schematic of electronic circuitry which may be used in conjunction with the sensor of certain embodiments of the present invention.

The sensor 10 of the first embodiment is preferably used in combination with programmable electronic circuitry 70 which is shown schematically in FIG. 26. The programmable electronic circuitry 70 used in conjunction with the sensor 10 is in electrical communication therewith, and may be operative to compare at least two successive states generated by the sensor 10 to each other. The electronic circuitry 70 may be programmed to translate at least some of the states generated by the sensor 10 into respective effects, and may be further programmed to produce a selective effect upon successive states of a prescribed sequence being transmitted thereto from the sensor 10. The effects may comprise visual outputs, audible outputs, or combinations thereof. The effects may also comprise electrical signals of differing frequencies and/or codings, infrared signals of differing codings, radio signals of differing frequencies and/or codings, microwave signals of differing frequencies and/or codings, or combinations thereof. The successive states generated by the sensor 10 which may be compared by the electronic circuitry 70 correspond to the movement of the trigger mechanism (i.e., trigger plate 60 and trigger balls 68) within the interior chamber of the housing 12.

Like the electronic circuitry used in conjunction with the sensor 601 as described in the parent application, the electronic circuitry 70 further includes the capability to discern a multiplicity of different conditions of the sensor 10, and to compare successive conditions to each other to determine the path of movement (i.e., clockwise, counter-clockwise) of the trigger mechanism within the interior chamber of the housing 12. As indicated above, sixteen different high states may be generated by the sensor 10 depending upon the particular combination of switches 54 and bottom or top inner pads 46, 28 being actuated by the protuberance(s) 64 and trigger ball(s) 68. As the trigger mechanism rotates within the interior chamber of the housing 12, a low state is generated between any successive pair of high states. Thus, during a complete clockwise or counter-clockwise rotation of the trigger mechanism within the interior chamber, at least sixteen conditions are achieved comprising the sum of at least eight different high states and the eight intervening low states. As indicated above, the electronic circuitry 70 used in conjunction with the sensor 10 is able to discern these different conditions, and to compare any three of these conditions to each other for purposes of monitoring the location or direction of rotation of the trigger mechanism within the interior chamber of the housing 12. The electronic circuitry 70 may be programmed to produce a certain effect or combination of effects in response to any three successive conditions transmitted from the sensor 10.

As further seen in FIG. 26, the electronic circuitry 70 includes an MPU 72. The MPU 72 includes a total of eight input/output ports or i/o's which are labeled as P10–P13 and P20–P23. The switches 54 and hence the bottom inner pads 46 are electrically connected to respective ones of the i/o's of the MPU 72. The MPU 72 is operative to determine which of the top and bottom plates 18, 34 is disposed closer to the reference plane (i.e., whether the sensor 10 is upside down) based on the high state(s) being generated by the sensor 10, and more particularly the i/o(s) to which current is transmitted. Similarly, the top inner pads 28 are electrically connected to respective ones of the i/o's of the MPU 72. To facilitate the creation of the required conductive path through the sensor 10, it is contemplated that one of the top and bottom pins 26, 44 will be in electrical communication with the electronic circuitry 70 in a manner permitting an electrical signal to be transmitted therefrom and to the switch(es) 54 and bottom or top inner pad(s) 46, 28 via the protuberance(s) 64 of the trigger plate 60 and trigger ball(s) 68. That one of the top and bottom pins 26, 44 not used to facilitate the transmission of an electrical signal to the trigger mechanism is preferably used to establish a common ground to the electronic circuitry 70.

Figure 5:
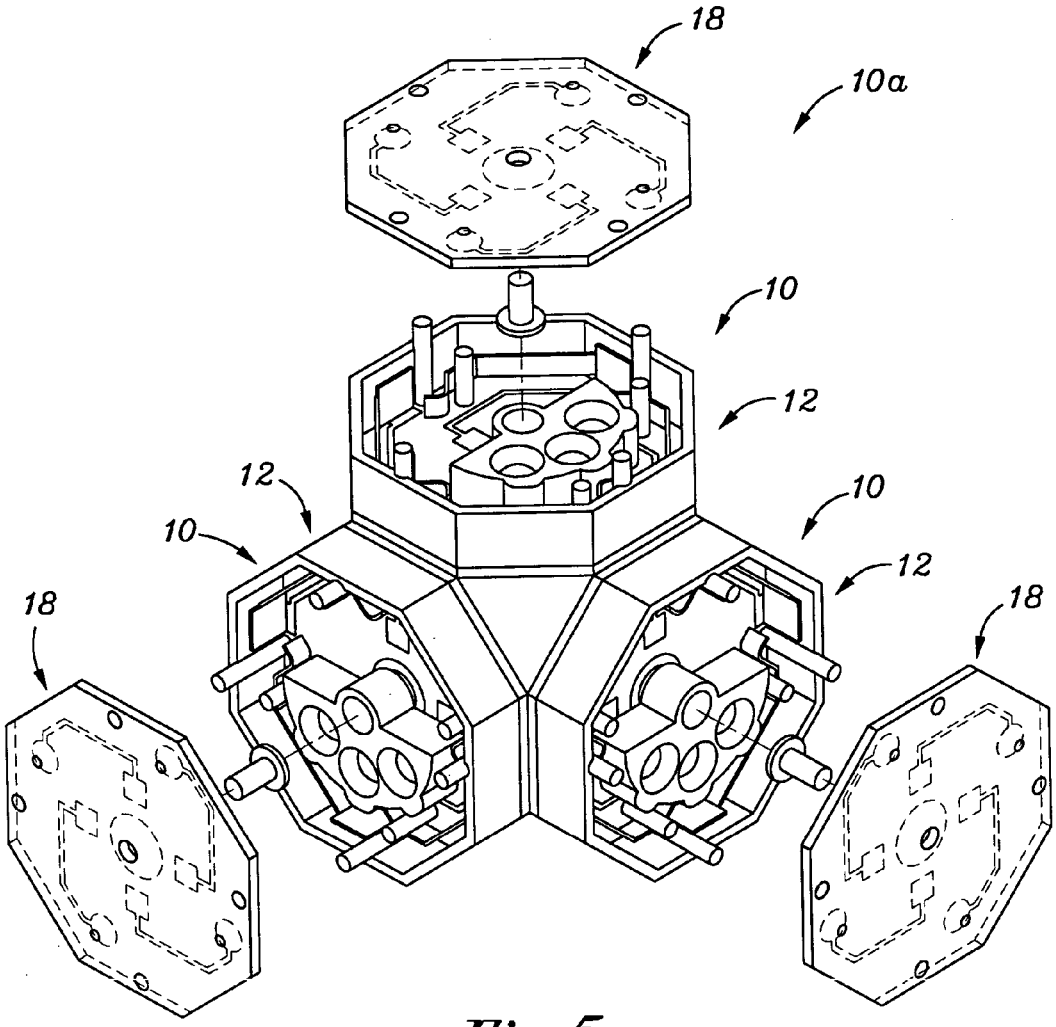
FIG. 5 is a perspective view of a multi-axis version of the sensor of the first embodiment, illustrating the top plates as separated from the remainder thereof.

Referring now to FIG. 5, there is depicted a sensor 10*a* which is a three-axis version of the sensor 10. In the sensor 10*a*, the housings 12 of three identically configured sensors 10 are attached to each other or to a common mount such that each corresponding pair of top and bottom pins 26, 44 is coaxially aligned with a respective one of the different axes which extend in generally perpendicular relation to each other. Each of the sensors 10 of the sensor 10*a* functions in the above-described manner. The sensor 10*a* would be operative to generate the low state when the protuberances 64 of the trigger plates 60 and trigger balls 68 are not in contact with any of the switches 54 and bottom or top inner pads 46, 28, and at least four thousand and ninety six different high states (sixteen to the third power based on three axes) corresponding to the contact between the protuberances 64 and at least one of the switches 54, and between the trigger balls 68 and at least one of the bottom or top inner pads 46, 28. The electronic circuitry used in conjunction with the sensor 10*a* would provide the same functionality as the electronic circuitry 70, i.e., differentiating and/or comparing states and/or conditions, and generating resultant effects.

Referring now to FIGS. 6–9, there is depicted a sensor 100 constructed in accordance with the second embodiment of the present invention. The sensor 100 is substantially similar in structure and function to the sensor 10 of the first embodiment as described above. The sensor 100 comprises a housing 112, which itself comprises an octagonally shaped side wall 114. The side wall 114 defines top and bottom peripheral rims, and includes four cylindrically configured post portions 116 integrally connected to respective ones of four side wall segments thereof. The post portions 116 are sized relative to the remainder of the side wall 114 so as to protrude beyond the top and bottom peripheral rims thereof.

Figure 7:
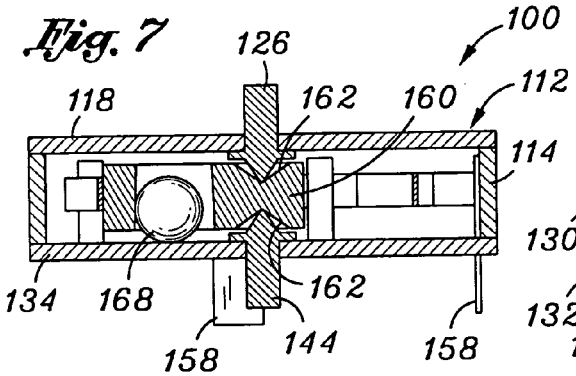
FIG. 7 is a cross-sectional view of the sensor of the second embodiment.

In addition to the side wall 114, the housing 112 comprises an octagonally shaped top plate 118 which is attached to the side wall 114 in a manner wherein a peripheral portion of the inner surface of the top plate 118 abuts the top peripheral rim of the side wall 114. To maintain a proper registry between the side wall 114 and the top plate 118, disposed within the top plate 118 are four apertures 120 which are sized and configured to receive respective ones of the post portions 116 of the side wall 114. When the top plate 118 is properly secured to the side wall 114, the peripheral edge of the top plate 118 is substantially flush with the outer surface of the side wall 114. Disposed in the approximate center of the top plate 118 is an aperture 122. Additionally, disposed in the approximate center of the inner surface of the top plate 118 is a circularly configured conductive pad 124. The aperture 122 is concentrically positioned within the conductive pad 124. The aperture 122 is sized and configured to receive a top pin 126 of the sensor 100. As seen in FIG. 7, the top pin 126 includes a radially extending flange portion which is abutted against the conductive pad 124 when the top pin 126 is fully inserted into the aperture 122. The top pin 126 further defines a pointed inner end, and is preferably fabricated from a conductive metal material.

Figure 8:
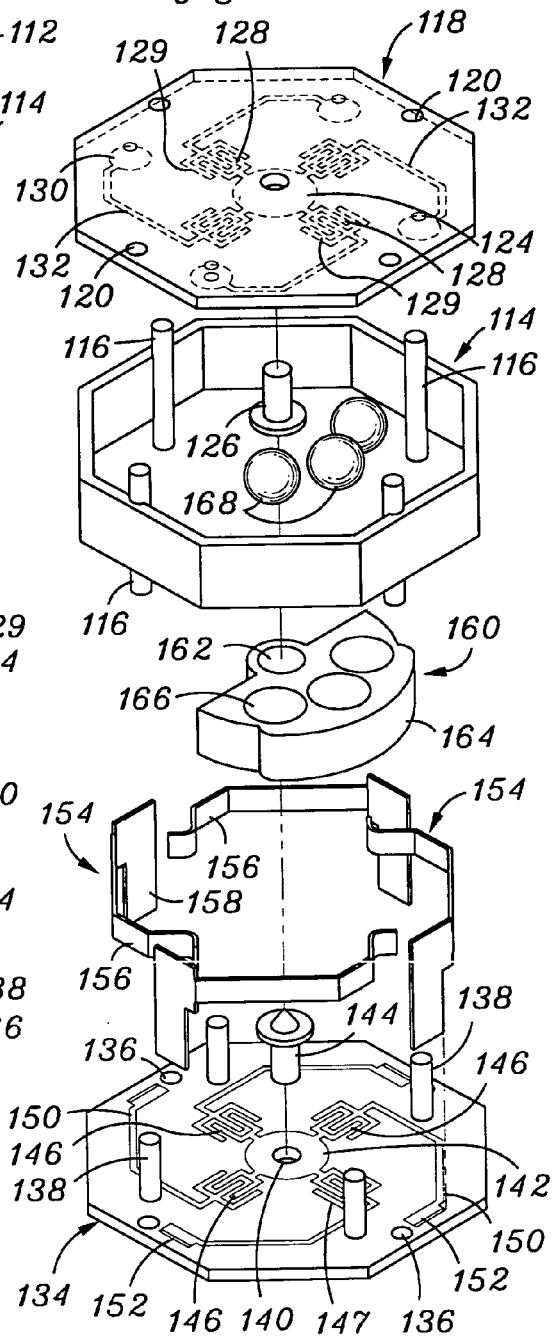
FIG. 8 is an exploded view of the sensor of the second embodiment.
Figure 6:
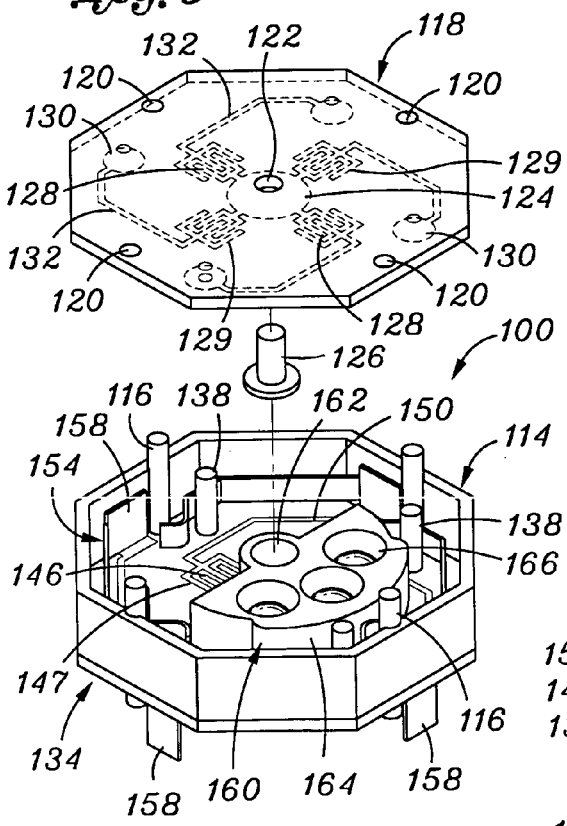
FIG. 6 is a top perspective view of a sensor constructed in accordance with a second embodiment of the present invention, illustrating the top plate as separated from the remainder thereof.

In addition to the pad 124, also disposed on the inner surface of the top plate 118 are four generally U-shaped first top inner pads 128 which are each electrically connected to the pad 124 and are disposed thereabout (i.e., are separated from each other) at equidistant intervals of approximately ninety degrees. Also disposed on the inner surface of the top plate 118 are four generally E-shaped second top inner pads 129 which are also separated from each other at intervals of approximately ninety degrees, and are intermeshed with respective ones of the first top inner pads 128. However, as seen in FIGS. 6 and 8, the second top inner pads 129 are not in direct electrical communication with the corresponding first top inner pads 128. In addition to the pads 124, 128, 129, disposed on the inner surface of the top plate 118 are four circularly configured conductive top outer pads 130. Each of the second top inner pads 129 is electrically connected to a respective one of the top outer pads 130 via a conductive trace 132 which extends therebetween. The pads 124, 128, 129, 130 and traces 132 are preferably formed of very thin copper via conventional etching techniques. As such, like the top plate 18, the top plate 118 is preferably fabricated from a conventional printed circuit board (PCB) material.

The housing 112 of the sensor 100 further comprises an octagonally shaped bottom plate 134 which is attached to the side wall 114 such that a peripheral portion of the inner surface of the bottom plate 134 abuts the bottom peripheral rim of the side wall 114. To maintain proper registry between the side wall 114 and the bottom plate 134, disposed within the bottom plate 134 are four apertures 136 which are adapted to receive respective ones of the post portions 116 of the side wall 114, and in particular those portions of the post portions 116 which protrude beyond the bottom peripheral rim of the side wall 114. Extending perpendicularly from the inner surface of the bottom plate 134 are four cylindrically configured bosses 138.

Disposed within the approximate center of the bottom plate 134 is an aperture 140. Similar to the top plate 118, disposed in the approximate center of the inner surface of the bottom plate 134 is a circularly configured conductive pad 142. The aperture 140 is concentrically positioned within the conductive pad 142, and is sized and configured to receive a bottom pin 144 which is identically configured to the top pin 126. The bottom pin 144 is preferably fabricated from a conductive metal material, and includes a radially extending flange portion which is abutted against the pad 142 when the bottom pin 144 is fully inserted into the aperture 140. Additionally, like the top pin 126, the bottom pin 144 defines a pointed inner end.

In addition to the pad 142, disposed on the inner surface of the bottom plate 134 are four generally U-shaped conductive first bottom inner pads 146 which are identically configured to the first top inner pads 128 and are disposed about the periphery of the pad 142 in equidistantly spaced intervals of approximately ninety degrees. Each of the first bottom inner pads 146 is electrically connected to the pad 142. Also disposed on the inner surface of the bottom plate 134 are four generally E-shaped second bottom inner pads 147 which are identically configured to the second top inner pads 129. In this respect, the first bottom inner pads 146 are intermeshed with respective ones of the second bottom inner pads 147 in the same manner described above with respect to the intermesh of the first top inner pads 128 to respective ones of the second top inner pads 129.

In addition to the pads 142, 146, 147, disposed on the inner surface of the bottom plate 134 are four rectangularly configured bottom outer pads 148. Each of the second bottom inner pads 147 is electrically connected to a respective one of the bottom outer pads 148 via a conductive trace 150. The bottom outer pads 148 are disposed adjacent to and extend along respective ones of four elongate slots 152 disposed within the bottom plate 134. The pads 142, 146, 147, 148 are themselves preferably formed from very thin copper via conventional etching techniques. Additionally, like the top plate 118, the bottom plate 134 is preferably fabricated from a conventional printed circuit board material.

Figure 9C:
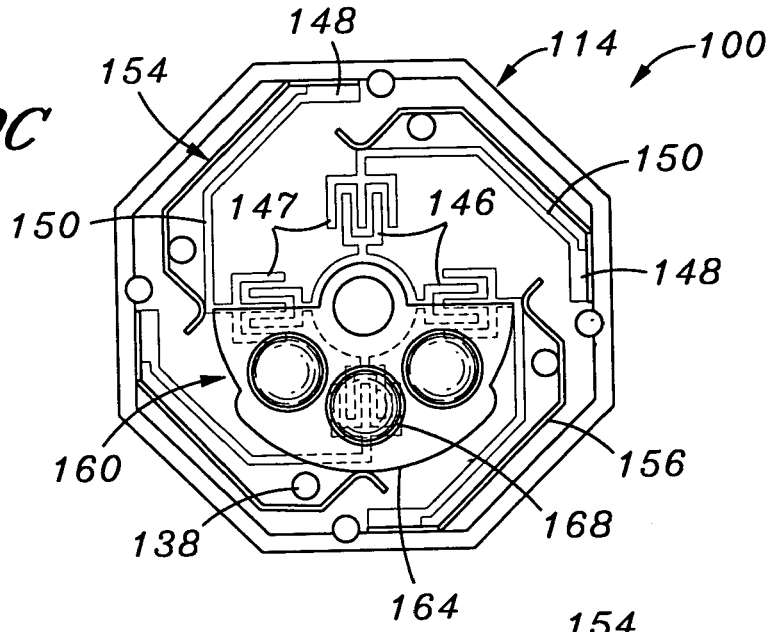
FIGS. 9A, 9B, 9C are top plan views of the sensor of the second embodiment not including the top plate, illustrating the manner in which the switches and contact plates of the sensor are individually or simultaneously actuated by the trigger mechanism of the sensor.
Figure 9B:
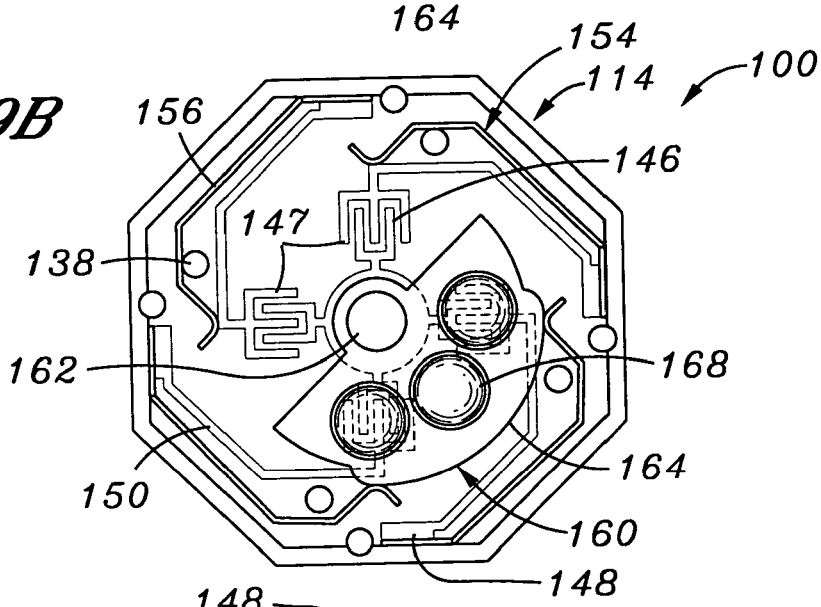
Figure 9A:
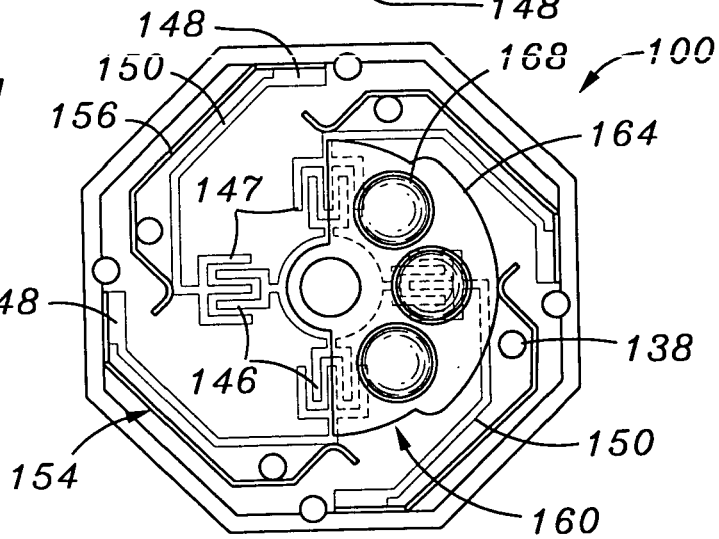

The sensor 100 of the second embodiment further comprises four identically configured switches 154 which are identically configured to the above-described switches 54, and are each preferably fabricated from a conductive metal material. Each of the switches 154 preferably comprises a resilient, flexible lead portion 156. In addition to the lead portion 156, each of the switches 154 includes a mount portion 158 which is integrally connected to one end of the lead portion 156. The mount portions 158 are sized and configured to be insertable into respective ones of the slots 152 within the bottom plate 134 so as to protrude from the outer surface thereof in the manner shown in FIGS. 6 and 7. The lead portions 156 are configured such that when the mount portions 158 are inserted into the bottom plate 134, the distal ends of the lead portions 156 will be separated from each other by intervals of approximately ninety degrees, as best seen in FIGS. 9A, 9B, and 9C. When the mount portions 158 of the switches 154 are advanced into respective ones of the slots 152, portions of the switches 154 abut and are thus in conductive contact with respective ones of the bottom outer pads 148 of the bottom plate 134. This conductive contact results in the lead portions 156 of the switches 154 being electrically connected to respective ones of the second inner pads 147 via respective ones of the bottom outer pads 148 and traces 150.

The housing 112 of the sensor 100 is assembled by attaching the top and bottom plates 118, 134 to the side wall 114 in the above-described manner. Upon such assembly, the inner surfaces of the top and bottom plates 118, 134 and inner surface of the side wall 114 collectively define an interior cavity or chamber of the housing 112. The lead portions 156 of the switches 154 are disposed within such interior chamber. The bosses 138 of the bottom plate 134 are adapted to act against respective ones of the lead portions 156 in a manner maintaining the same at prescribed orientations within the interior chamber of the housing 112. The distal end of each lead portion 156 is preferably configured to protrude radially inwardly within the interior chamber beyond the corresponding boss 138. Each corresponding, intermeshed pair of the first and second top inner pads 128, 129 and the first and second bottom inner pads 146, 147 is disposed between the coaxially aligned axes of the top and bottom pins 26, 44 and a respective one of the distal ends of the lead portions 156 of the switches 154.

The sensor 100 of the second embodiment further comprises a trigger plate 160 which is rotatably connected to the housing 112 and is disposed within the interior chamber defined thereby. The trigger plate 160 has a generally semi-circular shape, and is preferably fabricated from a conductive metal material. Disposed within the opposed top and bottom surfaces of the trigger plate 160 is a coaxially aligned pair of recesses 162 which are used to facilitate the rotatable connection of the trigger plate 160 to the housing 112. More particularly, as seen in FIG. 7, the pointed inner ends of the top and bottom pins 126, 144 are advanced into respective ones of the recesses 162 and engaged to the trigger plate 160. When the housing 112 is assembled in the above-described manner, the apertures 122, 140 within the top and bottom plates 118, 134 are coaxially aligned with each other, thus resulting in the inner ends of the top and bottom pins 126, 144 being coaxially aligned as well. The engagement of the inner ends of the top and bottom pins 126, 144 to the trigger plate 160 allows the trigger plate 160 to be freely rotatable within the interior chamber of the housing 112, yet prevented from upward or downward or side-to-side movement therewithin.

Though not shown, it will be recognized that the rotatable connection of the trigger plate 160 to the housing 112 may be facilitated by providing the trigger plate 160 and top and bottom pins 126, 144 with the alternative configurations discussed above in relation to the sensor 10 of the first embodiment. The pointed inner ends of the top and bottom pins 126, 144 loosely engage the trigger plate 160. Additionally, the preferred fabrication of the trigger plate 160 and the top and bottom pins 126, 144 from a conductive metal material and the conductive contact between the flange portions of the top and bottom pins 126, 144 and respective ones of the pads 124, 142 facilitates the placement of the trigger plate 160 into electrical communication with the pads 124, 142 via the top and bottom pins 126, 144.

The trigger plate 160 of the sensor 100 defines an arcuate outer surface portion which extends about one hundred eighty degrees. Formed on and extending radially outward from the outer surface portion is a protuberance 164 which extends about ninety degrees, and is preferably spaced from the opposed ends of the outer surface portion at equal intervals of approximately forty-five degrees. Additionally, disposed within the trigger plate 160 are three identically sized apertures 166, the outer pair of which are disposed adjacent respective ones of the opposed ends of the protuberance 164. The apertures 166 are spaced from each other at intervals of approximately forty-five degrees as well. Disposed within each of the apertures 166 is a spherically shaped trigger ball 168. As seen in FIG. 7, the diameter of each trigger ball 168 is less than the diameter of each aperture 160, thus allowing each trigger ball 168 to be freely movable and rotatable within its corresponding aperture 166. Each of the trigger balls 168 is also preferably fabricated from a conductive metal material. The trigger plate 160 and trigger balls 168 collectively define a trigger mechanism of the sensor 100.

When the trigger mechanism (i.e., the trigger plate 160 and trigger balls 168) of the sensor 100 is rotatably mounted within the interior chamber of the housing 112, the orientation of the apertures 166 and hence the trigger balls 168 within the trigger plate 160 allows each of the trigger balls 168 to be passable over or positionable upon any one of the corresponding pairs of the first and second bottom inner pads 146, 147 or the first and second top inner pads 128. 129. More particularly, when the sensor 100 is oriented relative to a generally horizontal reference plane such that the bottom plate 134 is disposed closer to the reference plane than the top plate 118, the trigger balls 168 will move or shift within the apertures 166 such that portions thereof will protrude from the bottom surface of the trigger plate 160 and directly contact the inner surface of the bottom plate 134. Conversely, if the sensor 100 is flipped over such that the top plate 118 is disposed closer to the reference plane than the bottom plate 134, the trigger balls 168 will move or shift within the apertures 166 such that portions thereof protrude from the top surface of the trigger plate 160 and directly contact the inner surface of the top plate 118.

Referring now to FIGS. 9A, 9B, and 9C, the sensor 100 of the second embodiment, like the sensor 10 of the first embodiment, has the capability of generating or producing a multiplicity of different states corresponding to respective positions of the sensor 100 relative to the reference plane. The movement of the sensor 100 relative to the reference plane facilitates the rotation of the trigger mechanism within the interior chamber of the housing 112. The sensor 100 is operative to generate a low state when the protuberance 164 of the trigger plate 160 is not in contact with any of the switches 154 and the trigger balls 168 are not in contact with any of the corresponding pairs of first and second bottom inner pads 146, 147 or first and second top inner pads 128, 129. The sensor 100 is further operative to generate four different high states corresponding to contact between the protuberances 164 and respective ones of the switches 154 (examples of which are shown in FIGS. 9A and 9C), and four additional high states corresponding to the protuberance 164 being in simultaneous contact with any pair of the distal ends of the lead portions 156 of the switches 154 separated by a ninety degree interval (an example of which is shown in FIG. 9B).

When the protuberances 164 of the trigger plate 160 moves into contact with the distal end of the lead portion 156 of a switch 154, a closed circuit condition is created since there is a complete conductive path comprising one or both of the top and bottom pins 126, 144, the trigger plate 160 (including the protuberance 164), and one or two of the switches 154 (including the lead and mount portions 156, 158). The particular high state generated by the sensor 100 is dependent upon the switch 155 with which electrical contact is established by the protuberance 164, i.e., each switch 154 produces a different high state when contacted by the protuberance 164. When the trigger plate 160 is positioned within the interior chamber of the housing 112 such that the protuberance 164 simultaneously contacts a pair of switches 154, the particular high state generated by the sensor 100 is dependent upon the combination of switches 154 with which electrical contact is established, i.e., a different high state is produced when any adjacent pair of switches 154 are simultaneously contacted by the protuberance 164.

As indicated above, each of the switches 154 is in conductive contact with a respective one of the bottom outer pads 148 due to the advancement of the mount portions 158 of the switches 154 into respective ones of the slots 152. Since each of the second bottom inner pads 147 is electrically connected to a respective bottom outer pad 148 via a corresponding trace 150, each second bottom inner pad 147 is thus electrically connected to a respective switch 154. Like the bottom inner pads 46 of the sensor 10 of the first embodiment, each corresponding pair of first and second bottom inner pads 146, 147 provides failsafe redundancy to a respective one of the switches 154. In this respect, in the event any lead portion 156 bends or warps such that conductive contact is not achieved between the same and the protuberance 164 during the rotation of the trigger plate 160, a closed circuit condition is still created since there is a complete conductive path comprising one or both of the top and bottom pins 126, 144, the trigger plate 160 (if current is introduced into the sensor 100 via the top pin 126), the pad 142, one or two of the first inner bottom pads 146, one or two of the trigger balls 168, one or two of the second bottom inner pads 147, one or two of the conductive traces 150, one or two of the bottom outer pads 148, and one or two of the switches 154. In this respect, electrical communication between the first and second bottom inner pads 146, 147 of any corresponding pair may be facilitated by one of the conductive trigger balls 368 being in simultaneous contact therewith.

The ability of any one of the trigger balls 68 to be brought into conductive contact with the first and second bottom inner pads 146, 147 of any corresponding pair at the same time is attributable to the intermeshed arrangement between each such corresponding pair. Each intermeshed pair of first and second bottom inner pads 146, 147, when contacted by the center trigger ball 168 facilitates the production of the same high state as the adjacent switch 154 when contacted by the protuberance 164. Similarly, the high state generated by the sensor 100 when any adjacent pair of the intermeshed first and second bottom inner pads 146, 147 are simultaneously contacted by respective ones of the outer pair of trigger balls 168 is identical to the high state generated when the corresponding switches 154 are simultaneously contacted by the protuberance 164.

As indicated above, if the sensor 100 is oriented such that the top plate 118 is disposed closer to the reference plane than the bottom plate 134, the trigger balls 168 will move or shift within the apertures 166 such that portions thereof protrude from the top surface of the trigger plate 160 and directly contact the inner surface of the top plate 118. The sensor 100 is further operative to generate four different high states (different from the high sates discussed above) corresponding to contact between the center trigger ball 168 and respective ones of the intermeshed pairs of the first and second top inner pads 128, 129, and four additional high states corresponding to the outer pair of trigger balls 168 being in simultaneous contact with any adjacent pair of the intermeshed first and second top inner pads 128, 129 separated by a ninety degree interval. A closed circuit condition is created by the complete conductive path comprising one or both of the top and bottom pins 126, 144, the trigger plate 160 (if current is introduced into the sensor 100 via the bottom pin 144), the pad 124, one or two of the first inner top pads 128, one or two of the trigger balls 168, one or two of the second inner top pads 129, one or two of the conductive traces 132, and one or two of the top outer pads 130. Thus, the sensor 100 has the capability of generating the low state and a totality of sixteen different high states. As in the sensor 10, the high states generated as a result of one of more of the trigger balls 168 being in contact with one or more of the intermeshed pairs of first and second top inner pads 128, 129 are indicative of the sensor 100 being generally upside down, i.e., the top plate 118 being disposed closer to the reference plane than the bottom plate 134.

The sensor 100 of the second embodiment is preferably used in combination with the above-described programmable electronic circuitry 70. The functionality imparted by the electronic circuitry 70 when used in conjunction with the sensor 100 is the same as that previously described in relation to the sensor 10 of the first embodiment. The switches 154 are electrically connected to respective ones of the i/o's of the MPU 72, as are the top inner pads 130.

Figure 10:
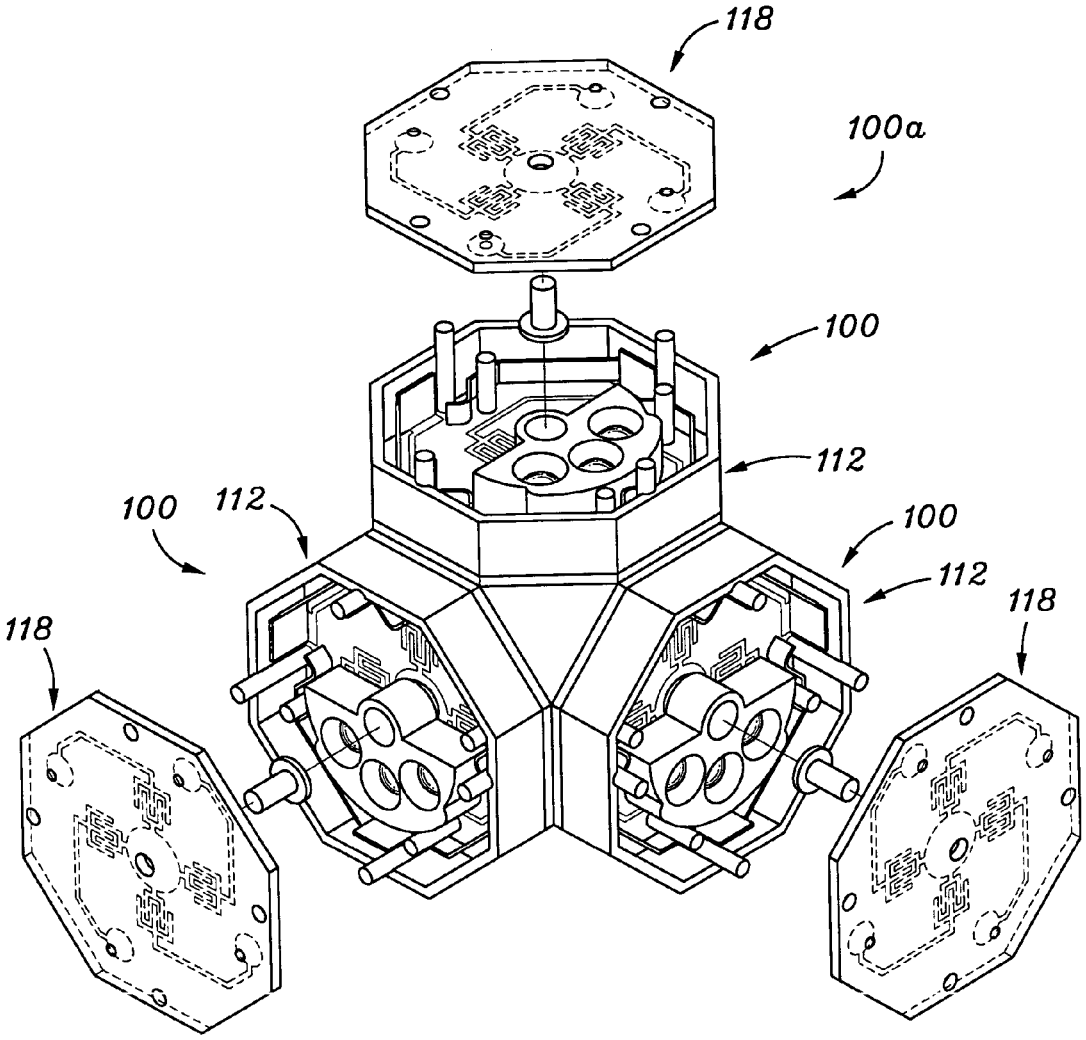
FIG. 10 is a perspective view of a multi-axis version of the sensor of the second embodiment, illustrating the top plates as separated from the remainder thereof.

Referring now to FIG. 10, there is depicted a sensor 100*a* which is a three-axis version of the sensor 100. In the sensor 100*a*, the housings 112 of three identically configured sensors 100 are attached to each other or to a common mount such that each corresponding pair of top and bottom pins 126, 144 is coaxially aligned with a respective one of three different axes which extend in generally perpendicular relation to each other. Each of the sensors 100 of the sensor 100*a* functions in the above-described manner. The sensor 100*a* would be operative to generate the low state when the protuberances 164 of the trigger plates 160 and trigger balls 168 are not in contact with any of the switches 154 and intermeshed pairs of first and second bottom inner pads 146, 147 or top inner pads 128, 129. The sensor 100*a* would further be operative to generate at least four thousand ninety six different high states (sixteen to the third power based on three axes) corresponding to the contact between the protuberances 164 and at least one of the switches 154, and between the trigger balls 168 and at least one of the intermeshed pairs of first and second bottom inner pads 146, 147 or top inner pads 128, 129. Electronic circuitry used in conjunction with the sensor 100*a* would provide the same functionality as the electronic circuitry 70, i.e., differentiating and/or comparing states and/or conditions, and generating resultant effects.

Figure 12:
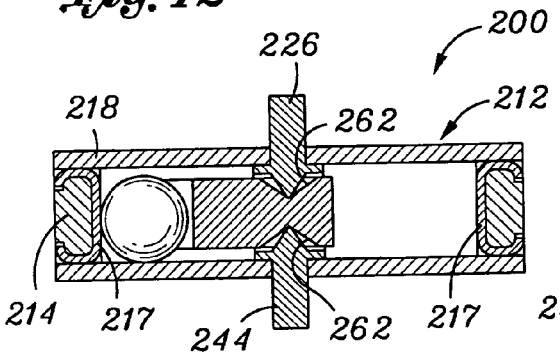
FIG. 12 is a cross-sectional view of the sensor of the third embodiment.
Figure 13:
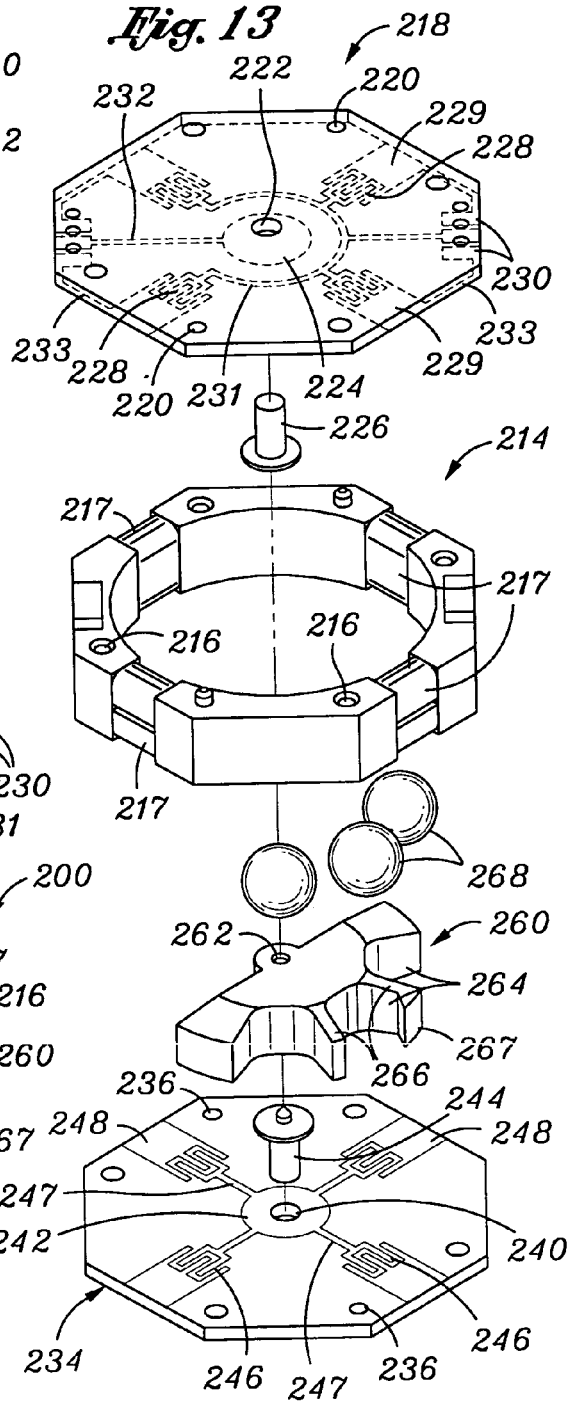
FIG. 13 is an exploded view of the sensor of the third embodiment.
Figure 11:
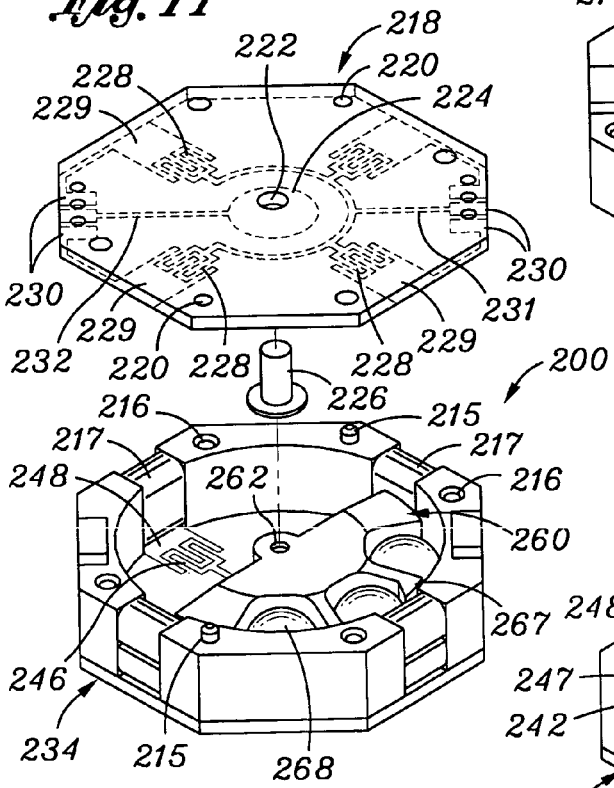
FIG. 11 is a top perspective view of a sensor constructed in accordance with a third embodiment of the present invention, illustrating the top plate as separated from the remainder thereof.

Referring now to FIGS. 11–13, there is depicted a sensor 200 constructed in accordance with a third embodiment of the present invention. The sensor 200 comprises a housing 212. The housing 212 itself comprises an octagonally shaped side wall 214 which defines top and bottom peripheral rims. Extending upwardly from each of the top and bottom peripheral rims is an opposed pair of generally cylindrical bosses 215. Additionally, disposed within each of the top and bottom peripheral rims are four apertures 216. As best seen in FIGS. 12 and 13, attached to the side wall 214 are four identically configured contact plates 217. Each of the contact plates 217 is preferably fabricated from a conductive metal material. Additionally, the contact plates 217 are attached to the side wall 214 so as to be equidistantly spaced from each other at intervals of approximately ninety degrees. As best seen in FIG. 13, the side wall 214 defines four equally sized arcuate inner surface sections. These inner surface sections and portions of the contact plates 217 collectively define a generally circular inner surface of the housing 212. Additionally, the contact plates 217 are sized relative to the side wall 214 such that portions of each of the contact plates 217 are substantially flush with each of the top and bottom peripheral rims of the side wall 214.

Figure 14A:
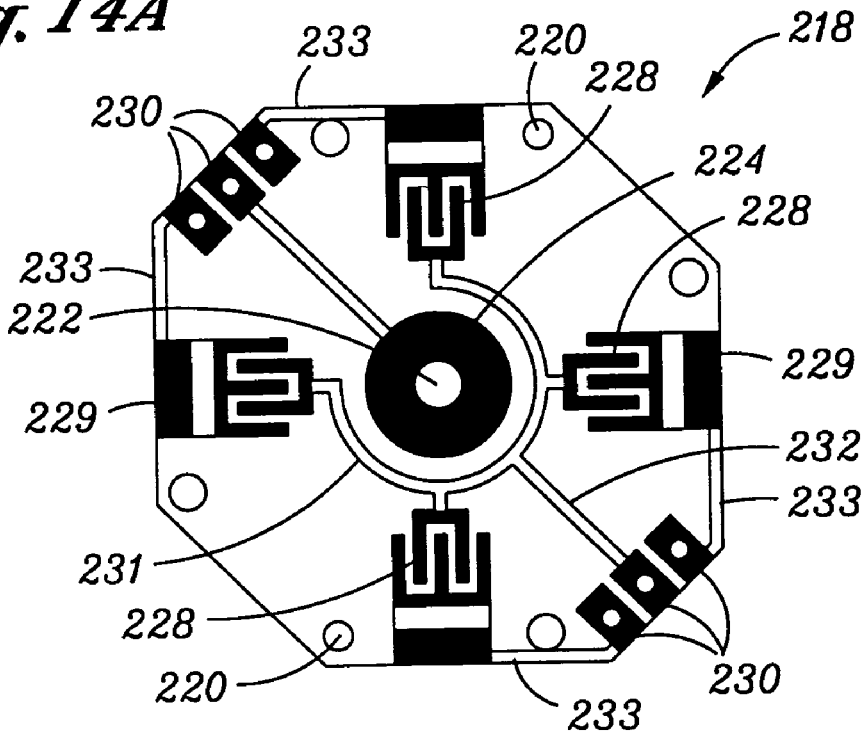
FIG. 14A is a top plan view of the top plate of the sensor of the third embodiment.

Referring now to FIGS. 11, 13, and 14A, in addition to the side wall 214, the housing 212 comprises an octagonally shaped top plate 218 which is attached to the side wall 214 in a manner wherein a peripheral portion of the inner surface of the top plate 218 abuts the top peripheral rim of the side wall 214. To maintain a proper registry between the side wall 214 and the top plate 218, disposed within the top plate 218 is an opposed pair of apertures 220 which are sized and configured to receive respective ones of the bosses 215. When the top plate 218 is properly secured to the side wall 214, the peripheral edge of the top plate 218 is substantially flush with the outer surface of the side wall 214. Disposed within the approximate center of the top plate 218 is an aperture 222. Additionally, disposed in the approximate center of the inner surface of the top plate 218 is a circularly configured conductive pad 224. The aperture 222 is concentrically positioned within the conductive pad 224. The aperture 222 is sized and configured to receive a top pin 226 of the sensor 200. As seen in FIG. 12, the top pin 226 includes a radially extending flange portion which is abutted against the conductive pad 224 when the top pin 226 is fully inserted into the aperture 222. The top pin 226 further defines a pointed inner end, and is preferably fabricated from a conductive metal material.

In addition to the pad 224, disposed on the inner surface of the top plate 218 are four generally U-shaped top inner pads 228 which are separated or spaced from each other at equidistant intervals of approximately ninety degrees. Also disposed on the inner surface of the top plate 218 are four generally E-shaped top outer pads 229 which are also separated from each other at equal intervals of approximately ninety degrees, and are intermeshed with respective ones of the top inner pads 228. Each of the top outer pads 229 extends along the inner surface of the top plate 218 to the peripheral edge thereof. The top inner pads 228 are not in direct electrical communication with the corresponding top outer pads 229. Further disposed on the inner surface of the top plate 218 are six top peripheral pads 230. The top peripheral pads 230 are segregated into two sets of three which are disposed in opposed relation to each other along respective peripheral edge segments of the top plate 218.

In the top plate 218, the top inner pads 228 are electrically connected to each other and to the center top peripheral pad 230 of one set thereof via a conductive trace 231 which includes an arcuate portion interconnecting the top inner pads 228 and a straight portion extending from the arcuate portion to the center top peripheral pad 230 of the corresponding set. Similarly, a generally straight conductive trace 232 is used to electrically connect the pad 224 to the center top peripheral pad 230 of the opposed, remaining set thereof. Further, conductive traces 233 are used to electrically connect the top outer pads 229 to respective ones of the remaining four outer top peripheral pads 230 of each of the two sets thereof.

The pads 224, 228, 229, 230 and traces 231, 232, 233 are each preferably formed of very thin copper via conventional etching techniques. As such, the top plate 218 is preferably fabricated from a conventional printed circuit board material. As best seen in FIG. 14A, it is contemplated that during the fabrication of the top plate 218, each of the conductive traces 231, 232, 233 will be covered or masked with a layer of insulating ink or other type of insulating material so as not to be exposed upon the inner surface of the top plate 218. As further seen in FIG. 14A, portions of each of the top outer pads 229 between the prongs thereof and the peripheral edge of the top plate 218 are also preferably covered or masked with a strip of the insulating ink.

Figure 14B:
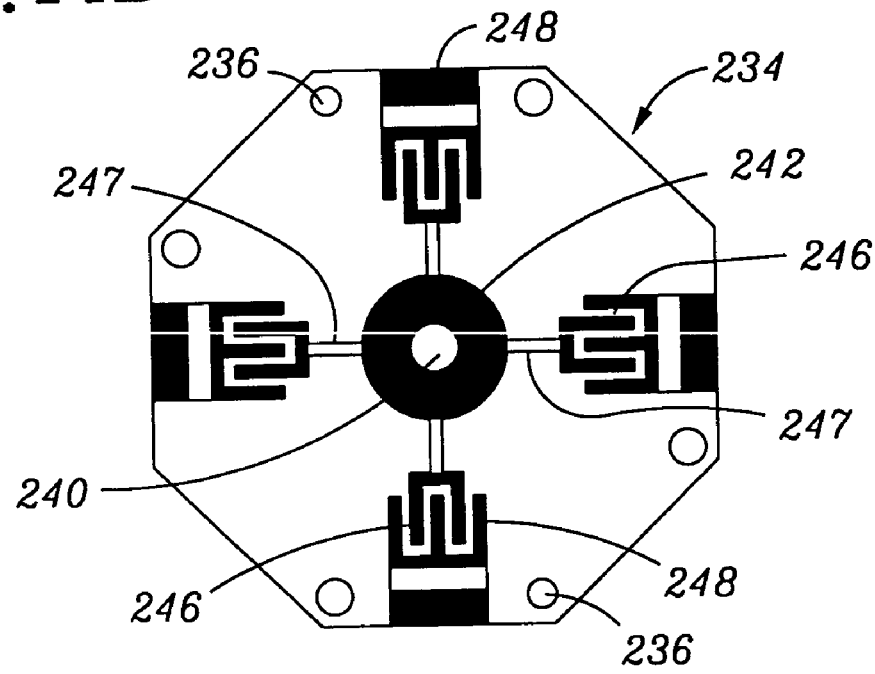
FIG. 14B is a top plan view of the bottom plate of the sensor of the third embodiment.

Referring now to FIGS. 13 and 14B, the housing 212 of the sensor 200 further comprises an octagonally shaped bottom plate 234 which is attached to the side wall 214 such that peripheral portion of the inner surface of the bottom plate 234 abuts the bottom peripheral rim of the side wall 214. To maintain proper registry between the side wall 214 and the bottom plate 234, disposed within the bottom plate 234 is an opposed pair of apertures 236 which are adapted to receive respective ones of the bosses 215 of the side wall 214, and in particular those bosses 215 which protrude from the bottom peripheral rim of the side wall 214. When the bottom plate 234 is properly secured to the side wall 214, the peripheral edge of the bottom plate 234 is substantially flush with the outer surface of the side wall 214.

Disposed within the approximate center of the bottom plate 234 is an aperture 240. Additionally, disposed in the approximate center of the inner surface of the bottom plate 234 is a circularly configured conductive pad 242. The aperture 240 is concentrically positioned within the conductive pad 242, and is sized and configured to receive a bottom pin 244 which is identically configured to the top pin 226. The bottom pin 244 is also preferably fabricated from a conductive metal material, and includes a radially extending flange portion which is abutted against the pad 242 when the bottom pin 244 is fully inserted into the aperture 240. The bottom pin 244, like the top pin 226, defines a pointed inner end.

In addition to the pad 242, disposed on the inner surface of the bottom plate 234 are four generally U-shaped conductive bottom inner pads 246 which are identically configured to the top inner pads 228 and are disposed about the periphery of the pad 242 in equidistantly spaced intervals of approximately ninety degrees. Each of the bottom inner pads 246 is electrically connected to the pad 242 via a generally straight conductive trace 247. Also disposed on the inner surface of the bottom plate 234 are four generally E-shaped bottom outer pads 248 which are identically configured to the top outer pads 229. Each of the bottom outer pads 248 extends along the inner surface of the bottom plate 234 to the peripheral edge thereof. Additionally, the bottom outer pads 248 are separated from each other at equal intervals of approximately ninety degrees, and are intermeshed with respective ones of the bottom inner pads 246. However, the bottom inner pads 246 are not in direct electrical communication with the corresponding bottom outer pads 248.

The pads 242, 246, 248 and traces 247 are each preferably formed of very thin copper via conventional etching techniques. As such, the bottom plate 234, like the top plate 218, is preferably fabricated from a conventional printed circuit board material. As best seen in FIG. 14B, it is contemplated that during the fabrication of the bottom plate 234, each of the conductive traces 247 will be covered or masked with a layer of insulating ink or other type of insulating material so as not to be exposed upon the inner surface of the bottom plate 234. As further seen in FIG. 14B, portions of each of the bottom outer pads 248 between the prongs thereof and the peripheral edge of the top plate 234 are also preferably covered or masked with a strip of the insulating ink.

The housing 212 of the sensor 200 is assembled by attaching the top and bottom plates 218, 234 to the side wall 214 in the above-described manner. Upon such assembly, the inner surfaces of the top and bottom plates 218, 234 and circular inner surface defined by the inner surface sections of the side wall 214 and portions of the contact plate 217 collectively define an interior cavity or chamber of the housing 212. Importantly, the side wall 214 and top and bottom plates 218, 234 are sized and configured relative to each other such that when the top and bottom plates 218, 234 are attached to the side wall 214, those portions of the contact plates 217 flush with the top peripheral rim of the side wall 214 are in abutting, electrical contact with respective ones of the top outer pads 229, and in particular those portions of the top outer pads 229 extending along the peripheral edge of the top plate 218. Similarly, those portions of the contact plates 217 substantially flush with the bottom peripheral rim of the side wall 214 are in abutting, electrical contact with respective ones of the bottom outer pads 248 of the bottom plate 234, and in particular those portions of the bottom outer pads 248 extending along the peripheral edge of the bottom plate 234. Thus, the top outer pads 229 are placed into electrical communication with respective ones of the intervening contact plates 217. Additionally, each corresponding, intermeshed pair of the top inner and outer pads 228, 229 and bottom inner and outer pads 246, 248 is disposed between the coaxially aligned axes of the top and bottom pins 226, 244 and a respective one of the contact plates 217.

The sensor 200 of the third embodiment further comprises a trigger plate 260 which is rotatably connected to the housing 212 and is disposed within the interior chamber defined thereby. The trigger plate 260 has a generally semi-circular shape, and is preferably fabricated from a conductive metal material. Disposed within the opposed top and bottom surfaces of the trigger plate 260 is a coaxially aligned pair of openings 262 which are used to facilitate the rotatable connection of the trigger plate 260 to the housing 212. As seen in FIG. 12, the pointed inner ends of the top and bottom pins 226, 244 are advanced into respective ones of the openings 262 and engaged to the trigger plate 260. When the housing 212 is assembled in the above-described manner, the apertures 222, 240 within the top and bottom plates 218, 234 are coaxially aligned with each other, thus resulting in the inner ends of the top and bottom pins 226, 244 being coaxially aligned as well. The engagement of the inner ends of the top and bottom pins 226, 244 to the trigger plate 260 allows the trigger plate 260 to be freely rotatable within the interior chamber of the housing 212, yet prevented from upward or downward or side-to-side movement therewithin. The pointed inner ends of the top and bottom pins 226, 244 loosely engage the trigger plate 260. Additionally, the preferred fabrication of the trigger plate 260 and the top and bottom pins 226, 244 from a conductive metal material and the conductive contact between the flange portions of the top and bottom pins 226, 244 and respective ones of the pads 224, 242 facilitates the placement of the trigger plate 260 into electrical communication with the pads 224, 242 via the top and bottom pins 226, 244.

The trigger plate 260 defines an arcuate outer surface portion which extends about one hundred eighty degrees. Formed within the outer surface portion are three cavities 264 which are preferably spaced from each other at equal intervals of approximately forty-five degrees, with the outer pair of cavities 264 being equally spaced from respective ones of the opposed ends of the outer surface portion. Disposed within each of the cavities 264 is a spherically shaped trigger ball 268. The diameter of each trigger ball 268 is less than the width of each cavity 264, thus allowing each trigger ball 268 to be freely movable and rotatable within its corresponding cavity 264. Each of the trigger balls 268 is also preferably fabricated from a conductive metal material. The trigger plate 260 and trigger balls 268 collectively define a trigger mechanism of the sensor 200.

As best seen in FIGS. 13, 15A, 15B, and 15C, the trigger plate 260 defines a pair of partition walls 266 which segregate or separate the center cavity 264 from the outer pair of cavities 264. One of these partition walls 266 is formed to include an enlarged distal end 267 which partially encloses the center cavity 264. This enlarged distal end 267 is operative to maintain the center trigger ball 268 disposed within the center cavity 264 in conductive contact with the trigger plate 260, as will be discussed in more detail below.

When the trigger mechanism (i.e., the trigger plate 260 and trigger balls 268) of the sensor 200 is rotatably mounted within the interior chamber of the housing 212, the orientation of the cavities 264 and hence the trigger balls 268 within the trigger plate 260 allows each of the trigger balls 268 to be passable over or positionable upon any one of the corresponding pairs of bottom inner and outer pads 246, 247 or top inner and outer pads 228, 229. More particularly, when the sensor 200 is oriented relative to a generally horizontal reference plane such that the bottom plate 234 is disposed closer to the reference plane than the top plate 218, the trigger balls 268 will move or shift within the cavities 264 such that portions thereof will protrude from the bottom surface of the trigger plate 260 and directly contact the inner surface of the bottom plate 234. Conversely, if the sensor 200 is flipped over such that the top plate 218 is disposed closer to the reference plane than the bottom plate 234, the trigger balls 268 will move or shift within the cavities 264 such that portions thereof protrude from the top surface of the trigger plate 260 and directly contact the inner surface of the top plate 218.

Figure 15C:
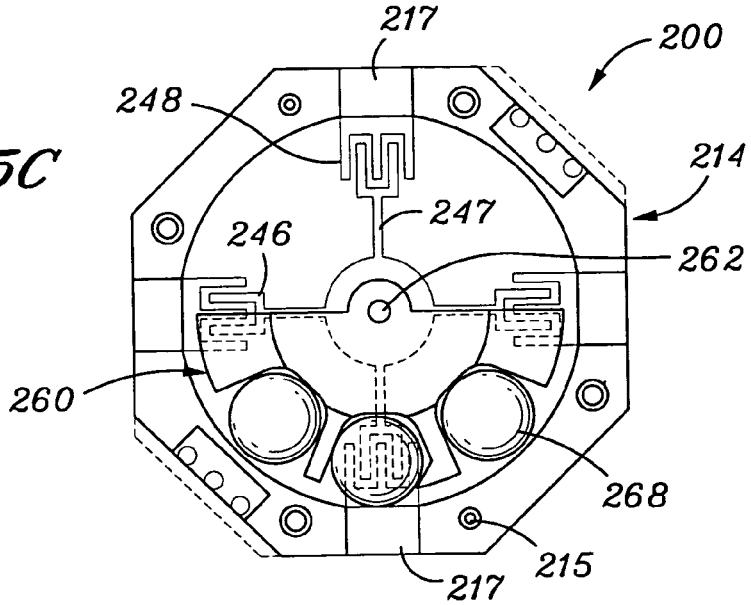
FIGS. 15A, 15B, 15C are top plan views of the sensor of the third embodiment not including the top plate, illustrating the manner in which the switches and contact plates of the sensor are individually or simultaneously actuated by the trigger mechanism of the sensor.
Figure 15B:
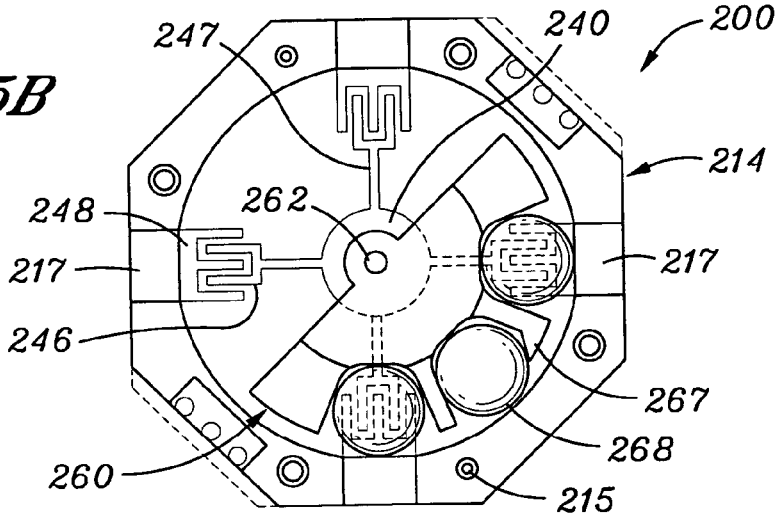
Figure 15A:
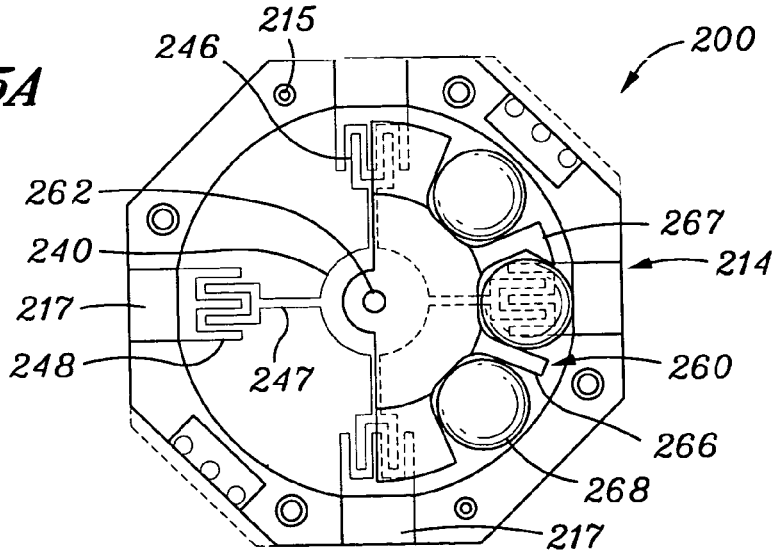

Referring now to FIGS. 15A, 15B, and 15C, the sensor 200 of the third embodiment itself has the capability of generating or producing a multiplicity of different states corresponding to respective positions of the sensor 200 relative to the reference plane. The movement of the sensor 200 relative to the reference plane facilitates the rotation of the trigger mechanism within the interior chamber of the housing 212. The sensor 200 is operative to generate a low state when the trigger balls 268 of the trigger mechanism are not in contact with any of the contact plates 217, and thus any of the corresponding pairs of bottom inner and outer pads 246, 248 or top inner and outer pads 228, 229. The sensor 200 is further operative to generate four different high states corresponding to contact between the center trigger ball 268 and respective ones of the contact plates 217 (examples of which are shown in FIGS. 15A and 15C), and four additional different high states corresponding to the outer pair of trigger balls 268 being in simultaneous contact with any pair of the contact plates 217 separated by a ninety degree interval (an example of which is shown in FIG. 15B). Another different high state is generated when any one of the trigger balls 268 is in contact with any corresponding pair of the bottom inner and outer pads 246, 247, with yet another different high state being generated when any one of the trigger balls 268 is in contact with any corresponding pair of the top inner and outer pads 228, 229.

When any trigger ball 268 moves into contact with a contact plate 217, a closed circuit condition is created since there is a complete conductive path comprising one or both of the top and bottom pins 226, 244, the trigger plate 260, one or two of the trigger balls 268, one or two of the contact plates 217, one or two of the top outer pads 229 (due to the conductive contact between the top outer pads 229 and respective ones of the contact plates 217), one or two of the conductive traces 233, and one or two of the outer top peripheral pads 230. The particular high state generated by the sensor 200 is dependent upon the contact plate 217 with which electrical contact is established by the center trigger ball 268, i.e., each contact plate 217 produces a different high state when contacted by the center trigger ball 268. When the trigger plate 260 is positioned within the interior chamber of the housing 212 such that the outer pair of trigger balls 268 simultaneously contact a corresponding pair of contact plates 217, the particular high state generated by the sensor 200 is dependent upon the combination of contact plates 217 with which electrical contact is established, i.e., a different high state is produced when any adjacent pair of contact plates 217 are simultaneously contacted by the outer pair of trigger balls 268.

As will be recognized, when the sensor 200 is disposed vertically relative to the reference plane (i.e., the top and bottom plates 218, 234 extend generally perpendicularly relative to the reference plane), the trigger balls 268 of the trigger mechanism may not be in contact with any of the intermeshed pairs of top inner and outer pads 228, 229 or bottom inner and outer pads 246, 248. Even in the absence of such contact, a particular high state may still be produced due to the conductive contact between the contact plates 217 and respective ones of the top outer pads 229, which are themselves electrically connected to respective ones of the top peripheral pads 230 via respective ones of the traces 233. As also indicated above, in addition to being in conductive contact with respective ones of the top outer pads 229, the contact plates 217 are further in conductive contact with respective ones of the bottom outer pads 248.

As also explained above, when the sensor 200 is oriented such that the bottom plate 234 is disposed closer to the reference plane than the top plate 218, the trigger balls 268 will be shifted within the cavities 264 so as to directly contact the inner surface of the bottom plate 234. In this instance, when any one of the trigger balls 268 is rotated into contact with any one of the contact plates 217, such trigger ball 268 will be in simultaneous conductive contact with the bottom inner and outer pads 246, 248 of the corresponding intermeshed pair. Thus, the bottom outer pads 248 provide redundancy to the contact plates 217 since, even if the trigger ball(s) 268 do not achieve proper conductive contact with the contact plate(s) 217, a closed circuit condition is still created by the complete conductive path comprising one or both of the top and bottom pins 226, 244, the trigger plate 260, one or two of the trigger balls 268, one or two of the conductive traces 233, and one or two of the top peripheral pads 230.

When any trigger ball 268 is in contact with any intermeshed pair of the bottom inner and outer pads 246, 248, a particular high state is generated by the sensor 200 which is indicative of the bottom plate 234 being disposed closer to the reference plane than the top plate 218 (i.e., the sensor 200 being disposed in a generally non-inverted orientation). This particular high state is generated as a result of the trigger ball(s) 268 being in conductive contact with the bottom inner pad(s) 246 and the resultant closed circuit condition created by the complete conductive path comprising the top and bottom pins 226, 244, the trigger plate 260, one or two of the trigger balls 268, one or two of the bottom inner pads 246, one or two of the conductive traces 247, the conductive pads 242, 224, the conductive trace 232, and the center top peripheral pad 230 of one set thereof.

Conversely, when the sensor 200 is flipped over (i.e., turned upside-down) such that the top plate 218 is disposed closer to the reference plane than the bottom plate 234, the trigger balls 268 will be shifted within the cavities 264 so as to be brought into direct contact with the inner surface of the top plate 218. In this instance, the top outer pads 229 provide redundancy to the contact between the trigger ball(s) 268 and the contact plate(s) 217 in a similar manner to that described above since, even in the absence of conductive contact between the trigger ball(s) 268 and the contact plate(s) 217, a closed circuit condition is still created by the complete conductive path comprising one or both of the top and bottom pins 226, 244, the trigger plate 260, one or two of the trigger balls 268, one or two of the top outer pads 229, one or two of the conductive traces 233, and one or two of the outer top peripheral pads 230.

The particular high state generated by the sensor 200 when any one of the trigger balls 268 is placed into conductive contact with any intermeshed pair of the top inner and outer pads 228, 229 is indicative of the sensor 200 being upside-down, i.e., the top plate 218 being disposed closer to the reference plane than the bottom plate 234. This particular high state is generated as a result of the closed circuit condition created by the complete conductive path comprising one or both of the top and bottom pins 226, 244, the trigger plate 260, one or two of the trigger balls 268, one or two of the top inner pads 228, the conductive trace 231, and the center top peripheral pad 230 of one set thereof. Thus, not only does the sensor 200 generate different high states depending upon whether the contact plates 217 are individually or simultaneously contacted by the trigger balls 268, the sensor 200 further generates additional high states depending on whether or not it is upside-down relative to the reference plane. The absence of any high states being generated which are indicative of either of the top or bottom plates 218, 234 being disposed closer to the reference plane is itself indicative of the sensor 200 being disposed in a generally vertical orientation relative thereto, i.e., the top and bottom plates 218, 234 extending generally perpendicularly relative to the reference plane, as could result in the trigger balls 268 not being in conductive contact with any intermeshed pair of the top inner and outer pads 228, 229 or bottom inner and outer pads 246, 248.

As the trigger mechanism comprising the trigger plate 260 and trigger balls 268 rotates within the interior chamber of the housing 212, the absence of the enlarged distal end 267 on one of the partition walls 266 could result in a situation where the center trigger ball 268 is removed from conductive contact with the trigger plate 260. In view of the configuration of the trigger plate 260, the outer pair of trigger balls 268 will, at the very least, always be in contact with at least the partition walls 266. If the sensor 200 was moved into an orientation relative to the reference plane wherein the center trigger ball 268 would be caused to move out of contact with both of the partition walls 266 at the same time, conductive contact is still maintained between the center trigger ball 268 and the trigger plate 260 due to the contact between the distal end 267 and the center trigger ball 268.

The sensor 200 of the third embodiment is preferably used in combination with the above-described programable electronic circuitry 70. The functionality imparted by the electronic circuitry 70 when used in conjunction with the sensor 200 is the same as that described above. However, rather than requiring all eight of the i/o's of the MPU 72, the sensor 200 requires only six i/o's. In this respect, the outer top peripheral pads 230 (a total of four) are electronically connected to respective ones of the i/o's of the MPU 72. Thus, while providing the same functional capability as the above-described sensors 10, 100 of the first and second embodiments, the sensor 200 of the third embodiment does so through the use of less i/o's of the MPU 72 (i.e., six i/o's as opposed to eight i/o's).

Figure 28:
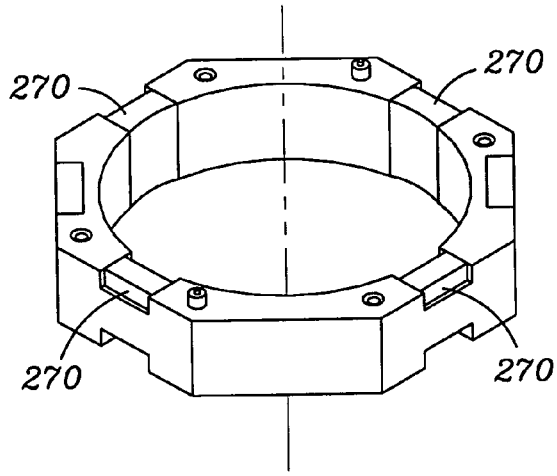
FIG. 28 is a top perspective view of an alternative side wall of the sensor housing which may be used in the sensors of the third and fourth embodiments of the present invention.

Referring now to FIG. 28, it is contemplated that as an alternative to the separate metallic contact plates 217 being attached to the side wall 214 at ninety degree intervals, a conductive coating may be applied to the side wall 214 in four (4) sections 270 which each mimic the configuration of the contact plates 217. In this respect, a portion of each section 270 is disposed on the inner surface of the side wall 14, with other portions of each section 270 being disposed upon each of the top and bottom peripheral rims of the side wall 214.

Figure 29:
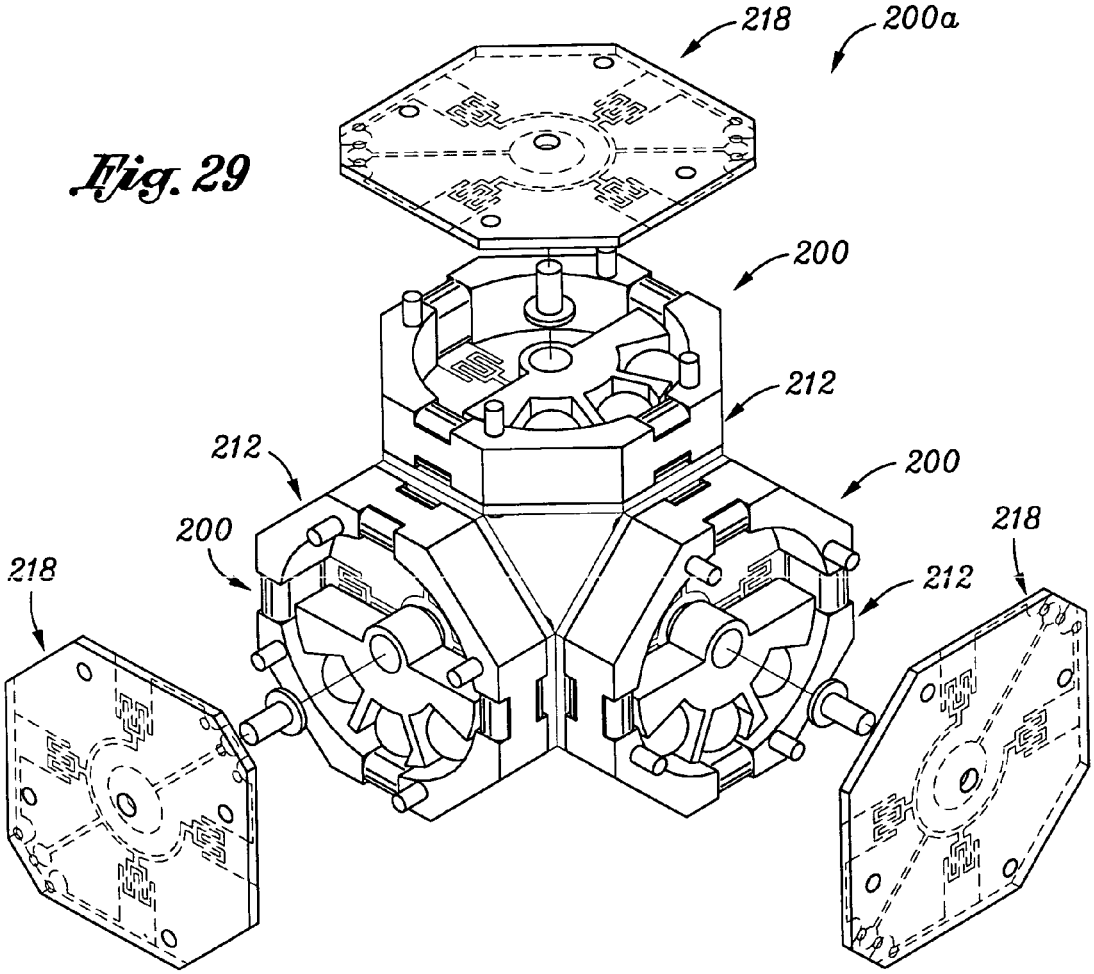
FIG. 29 is a perspective view of a multi-axis version of the sensor of the third embodiment, illustrating the top plates as separated from the remainder thereof.

Referring now to FIG. 29, there is depicted a sensor 200*a* which is a three-axis version of the sensor 200. In the sensor

200*a*, the housings 212 of three identically configured sensors 200 are attached to each other or to a common mount such that each corresponding pair of top and bottom pins 226, 244 is coaxially aligned with a respective one of three different axes which extend in generally perpendicular relation to each other. Each sensor 200 of the sensor 200*a* functions in the above-described manner.

Since each sensor 200 is operative to generate a low state and ten different high states as described above, the sensor 200*a* would itself be operative to generate the low state and at least one thousand different high states (ten to the third power based on three axes) depending on the orientation thereof relative to the reference plane. The electronic circuitry used in conjunction with the sensor 200*a* would provide the same functionality as the electronic circuitry 70, i.e., differentiating and/or comparing states and/or conditions, and generating resultant effects.

Figure 16:
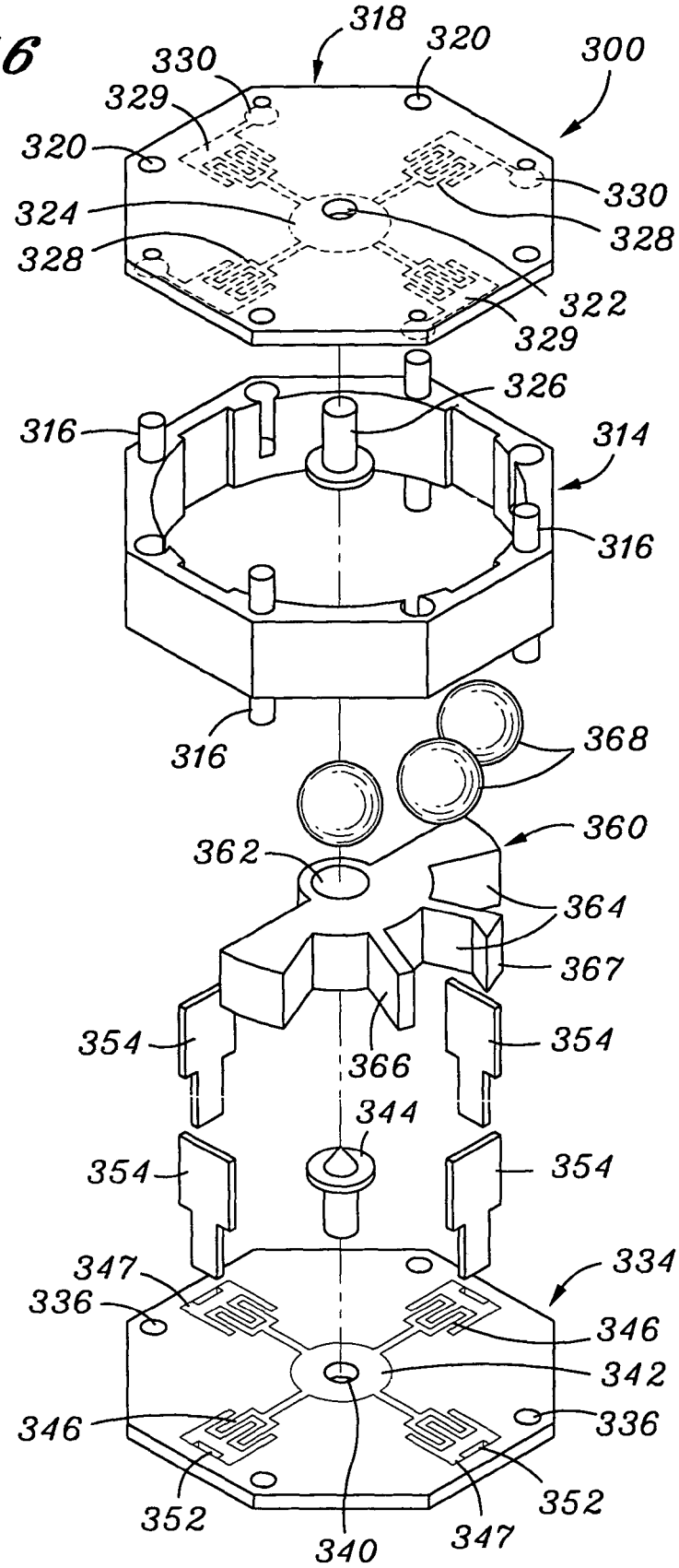
FIG. 16 is an exploded view of a sensor constructed in accordance with a fourth embodiment of the present invention.

Referring now to FIG. 16, there is depicted an exploded view of a sensor 300 constructed in accordance with a fourth embodiment of the present invention. The sensor 300 of the fourth embodiment essentially comprises a meld of the sensor 100 of the second embodiment and the sensor 200 of the third embodiment. The sensor 300 comprises an octagonally shaped side wall 314 which defines top and bottom peripheral rims, and includes four cylindrically configured post portions 316. The post portions 316 are sized relative to the remainder of the side wall 314 so as to protrude beyond the top and bottom peripheral rims thereof.

The sensor 300 further comprises an octagonally shaped top plate 318 which is attached to the side wall 314 in a manner wherein a peripheral portion of the inner surface of the top plate 318 abuts the top peripheral rim of the side wall 314. To maintain a proper registry between the side wall 314 and the top plate 318, disposed within the top plate 318 are four apertures 320 which are sized and configured to receive respective ones of the post portions 316. When the top plate 318 is properly secured to the side wall 314, the peripheral edge of the top plate 318 is substantially flush with the outer surface of the side wall 314. Disposed in the approximate center of the top plate 318 is an aperture 322. Additionally, disposed in the approximate center of the inner surface of the top plate 318 is a circularly configured conductive pad 324. The aperture 322 is concentrically positioned within the conductive pad 324. The aperture 322 is sized and configured to receive a top pin 326 of the sensor 300. The top pin 326 includes a radially extending flange portion which is abutted against the conductive pad 324 when the top pin 326 is fully inserted into the aperture 322. The top pin 326 further defines a pointed inner end, and is preferably fabricated from a conductive metal material.

In addition to the pad 324, also disposed on the inner surface of the top plate 318 are four generally U-shaped top inner pads 328 which are each electrically connected to the pad 324 via a conductive trace and are disposed thereabout (i.e., are separated from each other) at equidistant intervals of approximately ninety degrees. Also disposed on the inner surface of the top plate 318 are four generally E-shaped top outer pads 329 which are also separated from each other at intervals of approximately ninety degrees, and are intermeshed with respective ones of the top inner pads 328. The top outer pads 329 are not in direct electrical communication with the corresponding top inner pads 328. In addition to the pads 324, 328, 329, disposed on the inner surface of the top plate 318 are four circularly configured conductive top peripheral pads 330. Each of the top outer pads 329 is electrically connected to a respective one of the top peripheral pads 330 via a conductive trace which extends therebetween. The pads 324, 328, 329, 330 and traces are preferably formed of very thin copper via conventional etching techniques. Thus, the top plate 318 is preferably fabricated from a conventional printed circuit board (PCB) material.

The sensor 300 of the fourth embodiment further comprise an octangonally shaped bottom plate 334 which is attached to side wall 314 such that a peripheral portion of the inner surface of the bottom plate 334 abuts the bottom peripheral rim of the side wall 314. To maintain proper registry between the side wall 314 and the bottom plate 334, disposed within the bottom plate 334 are four apertures 336 which are adapted to receive respective ones of the post portions 316 of the side wall 314, and in particular those portions of the post portions 316 which protrude beyond the bottom peripheral rim of the side wall 314.

Disposed within the approximate center of the bottom plate 334 is an aperture 340. Additionally, disposed in the approximate center of the inner surface of the bottom plate 334 is a circularly configured conductive pad 342. The aperture 340 is concentrically positioned within the conducive pad 342, and is sized and configured to receive a bottom pin 344 which is identically configured to the top pin 326. The bottom pin 344 is also fabricated from a conductive metal material, and includes a radially extending flange portion which is abutted against the pad 342 when the bottom pin 344 is fully inserted into the aperture 340. The bottom pin 344 also defines a pointed inner end.

Also disposed on the inner surface of the bottom plate 334 are four generally U-shaped conductive bottom inner pads 346 which are identically configured to the top inner pads 328 and are disposed about the periphery of the pad 342 in equidistantly spaced intervals of approximately ninety degrees. Each of the bottom inner pads 346 is electrically connected to the pad 342 via a conductive trace. Also disposed on the inner surface of the bottom plate 344 are four generally E-shaped bottom outer pads 347 which are identically configured to the top outer pads 329. The bottom inner pads 346 are intermeshed with respective ones of the bottom outer pads 347 in the same manner described above with respect to the intermesh of the top inner pads 328 to respective ones of the top outer pads 329. Disposed within each of the bottom outer pads 347 is a slot 352, the use of which will be discussed in more detail below.

The sensor 300 of the fourth embodiment further comprises four identically configured contact plates 354. Each of the contact plates 354 comprises a main body portion, and a narrow stem portion which extends from one edge of the main body portion. The main body portions of the contact plates 354 are received into respective ones of four complementary notches formed within the inner surface of the side wall 314 at equidistant intervals of approximately ninety degrees. Upon the receipt of the main body portions of the contact plates 354 into the notches, the top edges of the main body portions are substantially flush with the top peripheral rim of the side wall 314, with the stem portions protruding downwardly from the bottom peripheral rim of the side wall 314. Upon the attachment of the top plate 318 to the side wall 314, the top outer pads 329 are brought into direct, conductive contact with respective ones of the contact plates 354, and in particular the top edges of the main body portions thereof. Additionally, upon the attachment of the bottom plate 334 to the side wall 314, the stem portions of the contact plates 354 are advanced into respective ones of the bottom outer pads 347. Thus, upon the assembly of the housing of the sensor 300, the contact plates 354 are electrically connected to both the top and bottom outer pads 329, 347, and hence to respective ones of the top peripheral pads 330.

The sensor 300 of the fourth embodiment further comprises a trigger plate 360 which is identically configured to the above-described trigger plate 260, and is rotatably connected to the housing defined by the attachment of the top and bottom plates 318, 334 to the side wall 314. More particularly, the trigger plate 360 is disposed within the interior chamber defined by such housing. The trigger plate 360 has a generally semi-circular shape, and is fabricated from a conductive metal material. Disposed within the opposed top and bottom surfaces of the trigger plate 360 is a coaxially aligned pair of openings 362 which are used to facilitate the rotatable connection of the trigger plate 360 to the housing. The pointed inner ends of the top and bottom pins 326, 344 are advanced into respective ones of the openings 362 and engaged to the trigger plate 360. When the housing of the sensor 300 is completely assembled, the apertures 322, 344 are advanced into respective ones of the openings 362 and engaged to the trigger plate 360. When the housing of the sensor 300 is completely assembled, the apertures 322, 340 within the top and bottom plates 318, 334 are coaxially aligned with each other, thus resulting in the inner ends of the top and bottom pins 326, 344 being coaxially aligned as well. The engagement of the inner ends of the top and bottom pins 326, 344 to the trigger plate 360 allows the trigger plate 360 to be freely rotatable within the interior chamber of the housing of the sensor 300. Additionally, the preferred fabrication of the trigger plate 360 and the top and bottom pins 326, 344 from a conductive metal material and the conductive contact of the flange portions of the top and bottom pins 326, 344 and respective ones of the pads 324, 342 facilitates the placement of the trigger plate 360 into electrical communication with the pads 324, 342 via the top and bottom pins 326, 344.

The trigger plate 360 defines an arcuate outer surface portion which extends about one hundred eighty degrees. Formed within the outer surface portion are three cavities 364 which are preferably spaced from each other at equal intervals of approximately forty-five degrees, with the outer pair of cavities 364 being equally spaced from respective ones of the opposed ends of the outer surface portion. Disposed within each of the cavities 364 is a spherically shaped trigger ball 368. The diameter of each trigger ball 368 is less than the width of each cavity 364, thus allowing each trigger ball 368 to be freely movable and rotatable within its corresponding cavity 364. Each of the trigger balls 368 is also fabricated from a conductive metal material. The trigger plate 360 and trigger balls 368 collectively define a trigger mechanism of the sensor 300.

The trigger plate 360 defines a pair of partition walls 366 which segregate or separate the center cavity 364 from the outer pair of cavities 364. One of these partition walls 366 is formed to include an enlarged distal end 367 which partially enclosed the center cavity 364 and is operative to maintain the center trigger ball 368 disposed within the center cavity 364 in conductive contact with the trigger plate 360 as discussed above in relation to the trigger plate 260. When the trigger mechanism (i.e., the trigger plate 360 and trigger balls 368) of the sensor 300 is rotatably mounted with the interior chamber of the housing thereof, the orientation of the cavities 364 and hence the trigger balls 368 within the trigger plate 360 allows each of the trigger balls 368 to be passable over or positionable upon any one of the intermeshed pairs of bottom inner and outer pads 346, 347 or top inner and outer pads 328, 329. When the sensor 300 is oriented relative to a generally horizontal reference plane such that the bottom plate 334 is disposed closer to the reference plane than the top plate 318, the trigger balls 366 will move or shift within the cavities 364 such that portions thereof will protrude from the bottom surface of the trigger plate 360 and directly contact the inner surface of the bottom plate 334. Conversely, if the sensor 300 is flipped over such that the top plate 318 is disposed closer to the reference plane than the bottom plate 334, the trigger balls 366 will move or shift within the cavities 364 such that portions thereof will protrude from the top surface of the trigger plate 360 and directly contact the inner surface of the top plate 318.

The sensor 300 of the fourth embodiment has the capability of generating or producing a multiplicity of different states corresponding to respective positions of the sensor 300 relative to the reference plane. The sensor 300 is operative to generate a low state when the trigger balls 368 of the trigger mechanism are not in contact with any of the contact plates 354, and any of the intermeshed pairs of bottom inner and outer pads 346, 347 or top inner and outer pads 228, 229. The sensor 300 is further operative to generate four different high states corresponding to contact between the center trigger ball 368 and respective ones of the contact plates 354, and four additional different high states corresponding to the outer pair of trigger balls 368 being in simultaneous contact with any pair of the contact plates 354 separated by a ninety degree interval.

When any trigger ball 368 moves into contact with a contact plate 354, a closed circuit condition is created since there is a complete conductive path comprising one or both of the top and bottom pins 326, 344, the trigger plate 360, one or two of the trigger balls 368, one or two of the contact plates 354, one or two of the top outer pads 329 (due to the conductive contact between the top outer pads 329 and respective ones of the contact plates 354), and one or two of the top peripheral pads 330. The particular high state generated by the sensor 300 is dependent upon the contact plate 354 with which electrical contact is established by the center trigger ball 368, i.e., each contact plate 354 produces a different high state when contacted by the center trigger ball 368. When the trigger plate 360 is positioned within the interior chamber of the housing of the sensor 300 such that the outer pair of trigger balls 368 simultaneously contact a corresponding pair of contact plates 354, the particular high state generated by the sensor 300 is dependent upon the combination of contact plates 354 with which electrical contact is established, i.e., a different high state is produced when any pair of adjacent contact plates 354 are simultaneously contacted by the outer pair of trigger balls 368.

In the sensor 300, each intermeshed pair of bottom inner and outer pads 346, 347 provides redundancy to a respective one of the contact plates 354. In this respect, in the event conductive contact is not achieved between a trigger ball 368 and a particular contact plate 354, a closed circuit condition is still created since there is a complete conductive path comprising one or both of the top and bottom pins 326, 344, the trigger plate 360 (if current is introduced into the sensor 300 via the top pin 326), the pad 342, one or two of the bottom inner pads 346, one or two of the trigger balls 368, one or two of the bottom outer pads 347, and one or two of the contact plates 354. In this respect, electrical communication between the bottom inner and outer pads 346, 347 of any corresponding pair may be facilitated by one of the conductive trigger balls 368 being in simultaneous contact therewith.

Each intermeshed pair of bottom inner and outer pads 346, 347, when contacted by the center trigger ball 368, facilitates the production of the same high state as the adjacent contact plate 354 when contacted by the center trigger ball 368. Similarly, the high state generated by the sensor 300 when any adjacent pair of the intermeshed bottom inner and outer pads 346, 347 are simultaneously contacted by respective ones of the outer pair of trigger balls 368 is identical to the high state generated when the corresponding contact plates 354 are simultaneously contacted by the outer pair of trigger balls 368.

If the sensor 300 is oriented such that the top plate 318 is disposed closer to the reference plane than the bottom plate 334, the sensor 300 is operative to generate four different high states (different from the high states discussed above) corresponding to contact between the center trigger ball 368 and respective ones of the intermeshed pairs of the top inner and outer pads 328, 329, and four additional different high states corresponding to the outer pair of trigger balls 368 being in simultaneous contact with any adjacent pair of the intermeshed top inner and outer pads 328, 329 separated by a ninety degree interval. A closed circuit condition is created by the complete conductive path comprising one or both of the top and bottom pins 326, 344, the trigger plate 360 (if current is introduced into the sensor 300 via the bottom pin 344), the pad 324, one or two of the top outer pads 329, and one or two of the top peripheral pads 330. Thus, the sensor 300 has the capability of generating the low state and a totality of sixteen different high states. The high states generated as a result of one or more of the trigger balls 368 being in contact with one or more of the intermeshed pairs of top inner and outer pads 328, 329 are indicative of the sensor 300 being generally upside-down, i.e., the top plate 318 being disposed closer to the reference plane than the bottom plate 334.

The sensor 300 of the fourth embodiment is preferably used in combination with the above-described programable electronic circuitry 70. The functionality imparted by the electronic circuitry 70 when used in conjunction with the sensor 300 is the same as that previously described in relation to the sensor 100 of the second embodiment. The contact plates 354 are electrically connected to respective ones of the i/o's of the MPU 72, as are the top peripheral pads 330. As a result, eight i/o's of the MPU 72 are utilized by the sensor 300 in the same manner eight i/o's of the MPU 72 are used by the sensor 100 of the second embodiment. Though not shown, those of ordinary skill in the art will recognize that the sensor 300 of the fourth embodiment may be provided in a three-axis version, with the states and conditions generated by such three-axis version being the same as previously described in relation to the sensor 100*a* (i.e., the three-axis version of the sensor 100).

Figure 18:
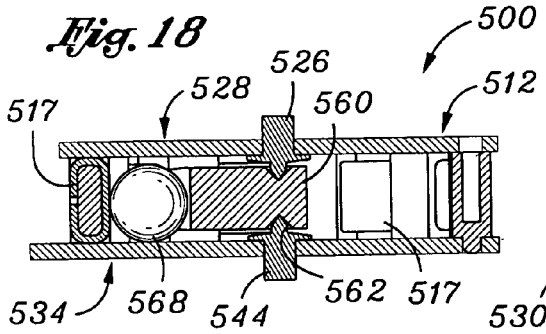
FIG. 18 is a cross-sectional view of the sensor of the fifth embodiment.
Figure 19:
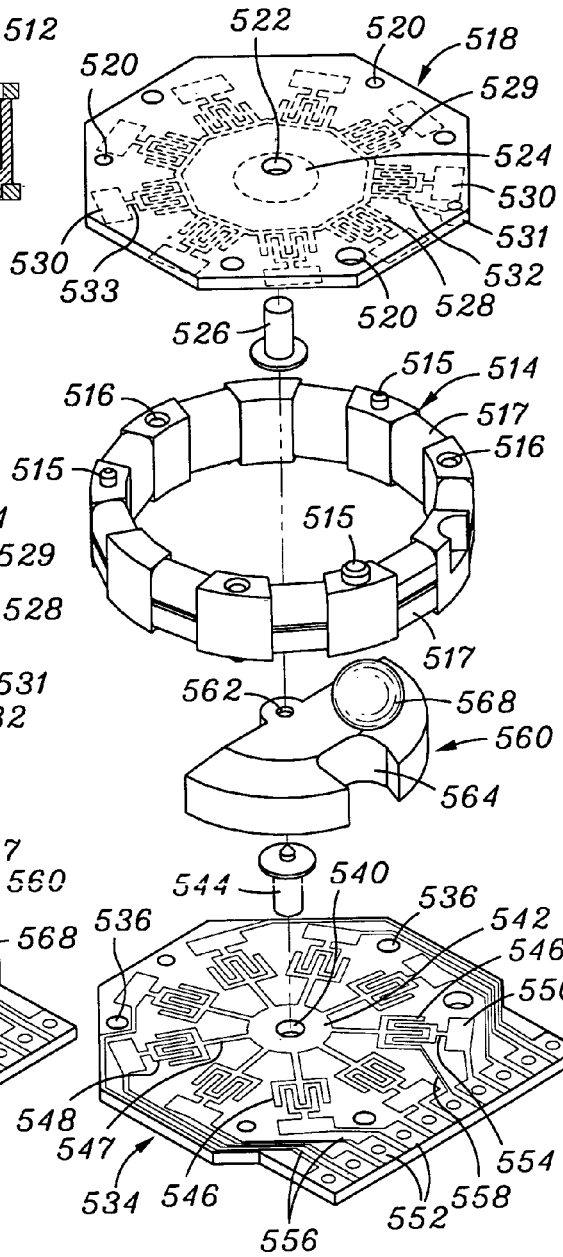
FIG. 19 is an exploded view of the sensor of the fifth embodiment.
Figure 17:
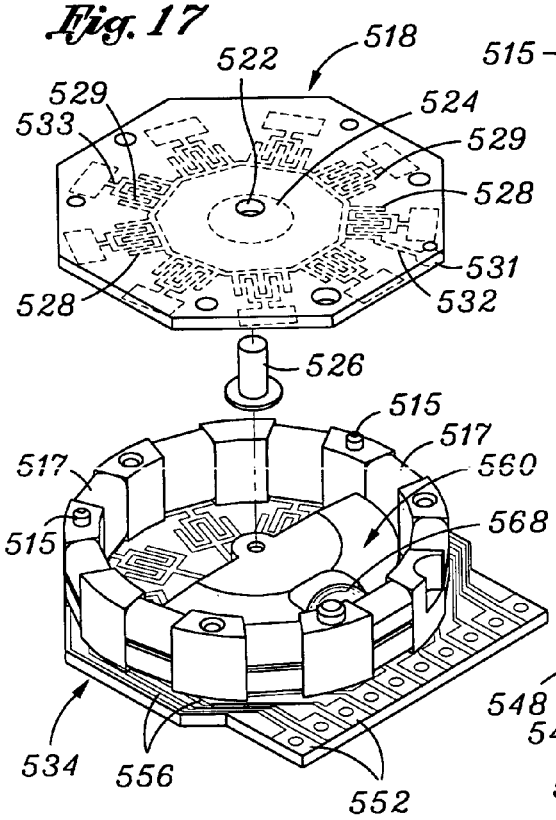
FIG. 17 is a top perspective view of a sensor constructed in accordance with a fifth embodiment of the present invention, illustrating the top plate as separated from the remainder thereof.

Referring now to FIGS. 17–19, there is depicted a sensor 500 constructed in accordance with a fifth embodiment of the present invention. The sensor 500 comprises a housing 512. The housing 512 itself comprises a circularly shaped side wall 514 which defines top and bottom peripheral rims. Extending upwardly from each of the top and bottom peripheral rims are generally cylindrical bosses 515. Additionally, disposed within each of the top and bottom peripheral rims are apertures 516. Attached to the side wall 514 are nine identically configured contact plates 517. Each of the contact plates 517 is preferably fabricated from a conductive metal material. The contact plates 517 are attached to the side wall 514 so as to be equidistantly spaced from each other at intervals of approximately forty degrees. The side wall 514 defines nine equally sized, arcuate inner surface sections. These inner surface sections and portions of the contact plates 517 collectively define a generally circular inner surface of the housing 512. Additionally, the contact plates 517 are sized relative to the side wall 514 such that portions of each of the contact plates 517 are substantially flush with each of the top and bottom peripheral rims of the side wall 514.

Figure 20A:
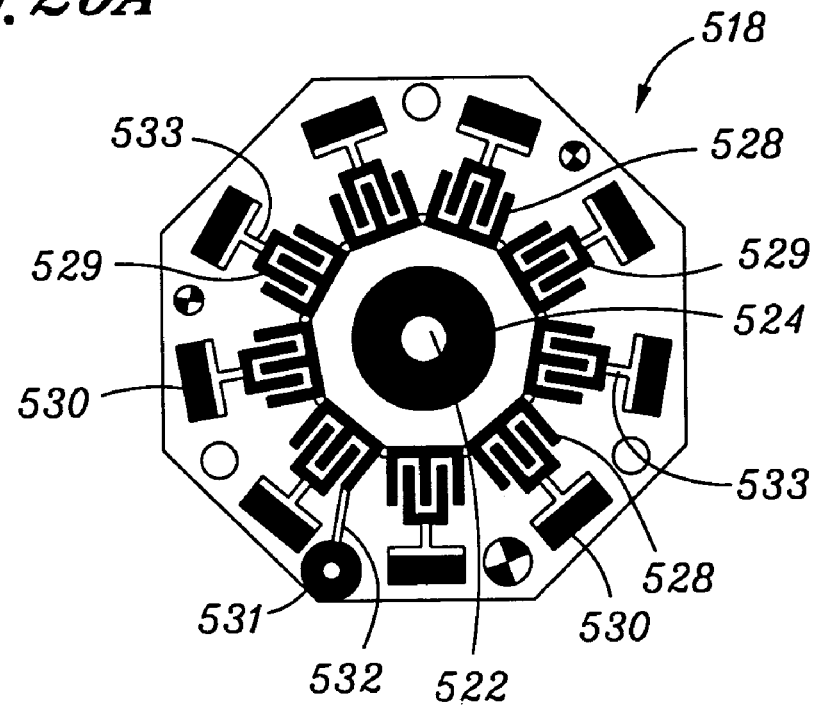
FIG. 20A is a top plan view of the top plate of the sensor of the fifth embodiment.

Referring now to FIGS. 17, 19, and 20A, in addition to the side wall 514, the housing 512 comprises an octagonally shaped top plate 518 which is attached to the side wall 514 in a manner wherein a peripheral portion of the inner surface of the top plate 518 abuts the top peripheral rim of the side wall 514. To maintain proper registry between the side wall 514 and the top plate 518, disposed within the top plate 518 are apertures 520 which are sized and configured to receive respective ones of the bosses 515. Disposed within the approximate center of the top plate 518 is an aperture 522. Additionally, disposed in the approximate center of the inner surface of the top plate 518 is a circularly configured conductive pad 524. The aperture 522 is concentrically positioned within the conductive pad 524. The aperture 522 is sized and configured to receive a top pin 526 of the sensor 500. As seen in FIG. 18, the top pin 526 includes a radially extending flange portion which is abutted against the conductive pad 524 when the top pin 526 is fully inserted into the aperture 522. The top pin 526 further defines a pointed inner end, and is preferably fabricated from a conductive metal material.

In addition to the pad 524, disposed on the inner surface of the top plate 518 are nine generally E-shaped top inner pads 528 which are separated or spaced from each other at equidistant intervals of approximately forty degrees. Also disposed on the inner surface of the top plate 518 are nine generally U-shaped top outer pads 529 which are also separated from each other at equal intervals of approximately forty degrees, and are intermeshed with respective ones of the top inner pads 528. Further disposed on the inner surface of the top plate 518 are nine rectangularly shaped top peripheral pads 530 which are also separated from each other at equal intervals of approximately forty degrees, and are disposed adjacent respective ones of the top outer pads 529. A circularly configured top output pad 531, which is best seen in FIG. 20A, is also disposed on the inner surface of the top plate 518. In the top plate 518, the top inner pads 528 are electrically connected to each other and to the top output pad 531 via a conductive trace 532. Additionally, conductive traces 533 are used to electrically connect the top outer pads 529 to respective ones of the top peripheral pads 530.

The pads 528, 529, 530, 531 and conductive traces 532, 533 are each preferably formed of very thin copper via conventional etching techniques. As such, the top plate 518 is preferably fabricated from a conventional printed circuit board material. As best seen in FIG. 20A, it is contemplated that during the fabrication of the top plate 518, each of the conductive traces 532, 533 will be covered or masked with a layer of insulating ink or other insulating material so as not to be exposed upon the inner surface of the top plate 518. As further seen in FIG. 20A, portions of each of the top peripheral pads 530 are also preferably covered or masked with a strip of the insulating ink.

The sensor 500 of the fifth embodiment further comprises a generally octagonal bottom plate 534 which is attached to the side wall 514 such that a peripheral portion of the bottom plate 534 abuts the bottom peripheral rim of the side wall 514. To maintain proper registry between the side wall 514 and the bottom plate 534, disposed within the bottom plate 534 are apertures 536 which are adapted to receive respective ones of the bosses 515. Disposed within the approximate center of the inner surface of the bottom plate 534 is a circularly configured conductive pad 542. The aperture 540 is concentrically positioned within the conductive pad 542, and is sized and configured to receive a bottom pin 544 which is identically configured to the top pin 526. The bottom pin 544 is also fabricated from a conductive metal material, and includes a radially extending flange portion which is abutted against the pad 542 when the bottom pin 544 is fully inserted into the aperture 540. The bottom pin 544 also defines a pointed inner end.

Also disposed on the inner surface of the bottom plate 534 are nine generally E-shaped conductive bottom inner pads 546 which are identically configured to the top inner pads 528 and are disposed about the periphery of the pad 542 in equidistantly spaced intervals of approximately forty degrees. Each of the bottom inner pads 546 is electrically connected to the pad 542 via a generally straight conductive trace 547. Further disposed on the inner surface of the bottom plate 544 are nine generally U-shaped bottom outer pads 548 which are identically configured to the top outer pads 529. The bottom inner pads 546 are intermeshed with respective ones of the bottom outer pads 548 in the same manner described above with respect to the intermesh of the top inner pads 528 to respective ones of the top outer pads 529.

In addition to the above-described pads 542, 546, 548, disposed on the inner surface of the bottom plate 534 are nine rectangularly shaped top peripheral pads 550 which are identically configured to the top peripheral pads 530 and are disposed adjacent to respective ones of the top outer pads 548. Also disposed on the top inner surface of the bottom plate 534 are ten bottom output pads 552 which extend in linear, spaced relation to each other along a common edge of the bottom plate 534. In the bottom plate 534, conductive traces 554 are used to electrically connect the bottom outer pads 548 to respective ones of the bottom peripheral pads 550. Additionally, conductive traces 556 are used to electrically connect the bottom peripheral pads 550 to respective ones of the bottom output pads 552. As best seen in FIGS. 19 and 20A, a conductive trace 558 electrically connects one of the bottom inner pads 546 directly to one of the bottom output pads 552. As such, all of the bottom inner pads 546 are electrically connected to one, common bottom output pad 552 by virtue of the electrical interconnection of the bottom inner pads 546 resulting from the conductive traces 547 and conductive pad 542.

Figure 20B:
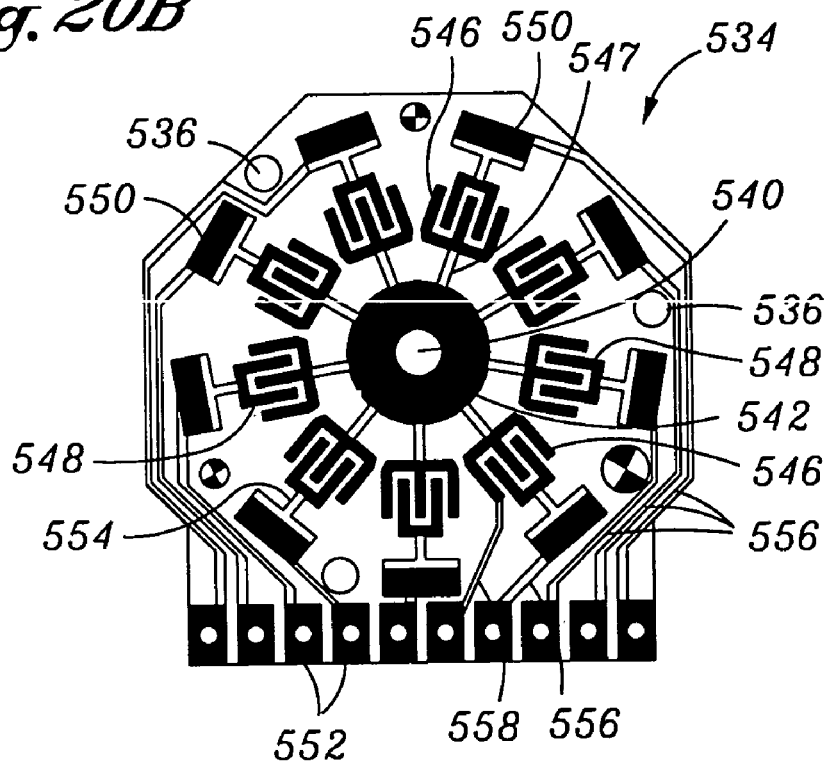
FIG. 20B is a top plan view of the bottom plate of the sensor of the fifth embodiment.

The pads 542, 546, 548, 550, 552 and traces 547, 554, 556, 558 are each preferably formed of very thin copper via conventional etching techniques. As such, the bottom plate 534, like the top plate 518, is preferably fabricated from a conventional printed circuit board material. As best seen in FIG. 20B, it is contemplated that during the fabrication of the bottom plate 534, each of the conductive traces 547, 554, 556, 558 will be covered or masked with a layer of insulating ink or other type of insulating material so as not to be exposed upon the inner surface of the bottom plate 534. As further seen in FIG. 20B, portions of each of the bottom peripheral pads 550 are also preferably covered or masked with a strip of the insulating ink.

The housing 512 of the sensor 500 is assembled by attaching the top and bottom plates 518, 534 to the side wall 514 in the above-described manner. Upon such assembly, the inner surfaces of the top and bottom plates 518, 534 and circular inner surfaces defined by the inner surface sections of the side wall 514 and portions of the contact plates 517 collectively define an interior cavity or chamber of the housing 512. The side wall 514 and top and bottom plates 518, 534 are sized and configured relative to each other such that when the top and bottom plates 518, 534 are attached to the side wall 514, those portions of the contact plates 517 flush with the top peripheral rim of the side wall 514 are in abutting, electrical contact with respective ones of the top peripheral pads 530. Similarly, those portions of the contact plates 517 substantially flush with the bottom peripheral rim of the side wall 514 are in abutting, electrical contact with respective ones of the bottom peripheral pads 550. Thus, the top peripheral pads 530 are placed into electrical communication with respective ones of the bottom peripheral pads 550 by respective ones of the intervening contact plates 517. Additionally, each corresponding, intermeshed pair of the top inner and outer pads 528, 529 and bottom inner and outer pads 546, 548 is disposed between the coaxially aligned axes of the top and bottom pins 526, 544 and a respective one of the contact plates 517.

The sensor 500 of the fifth embodiment further comprises a trigger plate 560 which is rotatably connected to the housing 512 and is disposed within the interior chamber defined thereby. The trigger plate 560 has a generally semi-circular shape, and is preferably fabricated from a conductive metal material. Disposed within the opposed top and bottom surfaces of the trigger plate 560 is a coaxially aligned pair of openings 562 which are used to facilitate the rotatable connection of the trigger plate 560 to the housing 512. As seen in FIG. 18, the pointed inner ends of the top and bottom pins 526, 544 are advanced into respective ones of the openings 562 and engaged to the trigger plate 560. When the housing 512 is assembled in the above-described manner, the apertures 522, 540 within the top and bottom plates 518, 534 are coaxially aligned as well. The engagement of the inner ends of the top and bottom pins 526, 544 to the trigger plate 560 allows the trigger plate 560 to be freely rotatable within the interior chamber of the housing 512, yet prevented from upward or downward or side-to-side movement therewithin. The pointed inner ends of the top and bottom pins 526, 544 loosely engage the trigger plate 560. Additionally, the preferred fabrication of the trigger plate 560 and the top and bottom pins 526, 544 from a conductive metal material and the conductive contact between the flange portions of the top and bottom pins 526, 544 and respective ones of the pads 524, 542 facilitates the placement of the trigger plate 560 into electrical communication with the pads 524, 542 via the top and bottom pins 526, 544.

The trigger plate 560 defines an arcuate outer surface portion which extends about one hundred eighty degrees. Formed within the approximate center of the outer surface portion is a cavity 564. Disposed within the cavity 564 is a spherically shaped trigger ball 568. The diameter of the trigger ball 568 is less than the width of the cavity 564, thus allowing the trigger ball 568 to be freely movable and rotatable within the cavity 564. The trigger ball 568 is also fabricated from a conductive metal material. The cavity 564 is specifically configured to maintain the trigger ball 568 in conductive contact with the trigger plate 560. The trigger plate 560 and trigger ball 568 collectively define a trigger mechanism of the sensor 500.

When the trigger mechanism (i.e., the trigger plate 560 and trigger ball 568) of the sensor 500 is rotatably mounted within the interior chamber of the housing 512, the orientation of the cavity 564 and hence the trigger ball 568 within the trigger plate 560 allows the trigger ball 568 to be passable over or positionable upon any one of the intermeshed pairs of bottom inner and outer pads 546, 548 or top inner and outer pads 528, 529. More particularly, when the sensor 500 is oriented relative to a generally horizontal reference plane such that the bottom plate 534 is disposed closer to the reference plane such that the bottom plate 534 is disposed closer to the reference plane than the top plate 518, the trigger ball 568 will more or shift within the cavity 564 such that a portion thereof will protrude from the bottom surface of the trigger plate 560 and directly contact the inner surface of the bottom plate 534 in the manner shown in FIG. 18. Conversely, if the sensor 500 is flipped over such that the top plate 518 is disposed closer to the reference plane than the bottom plate 534, the trigger ball 568 will move or shift within the cavity 564 such that a portion thereof will protrude from the top surface of the trigger plate 560 and directly contact the inner surface of the top plate 518.

Figure 21C:
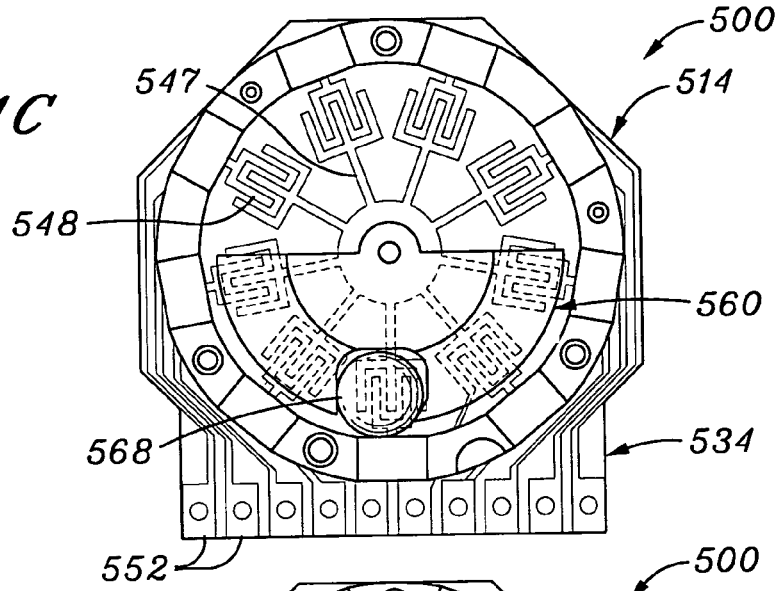
FIGS. 21A, 21B, 21C are top plan views of the sensor of the fifth embodiment not including the top plate, illustrating the manner in which the switches and contact plates of the sensor are individually or simultaneously actuated by the trigger mechanism of the sensor.
Figure 21B:
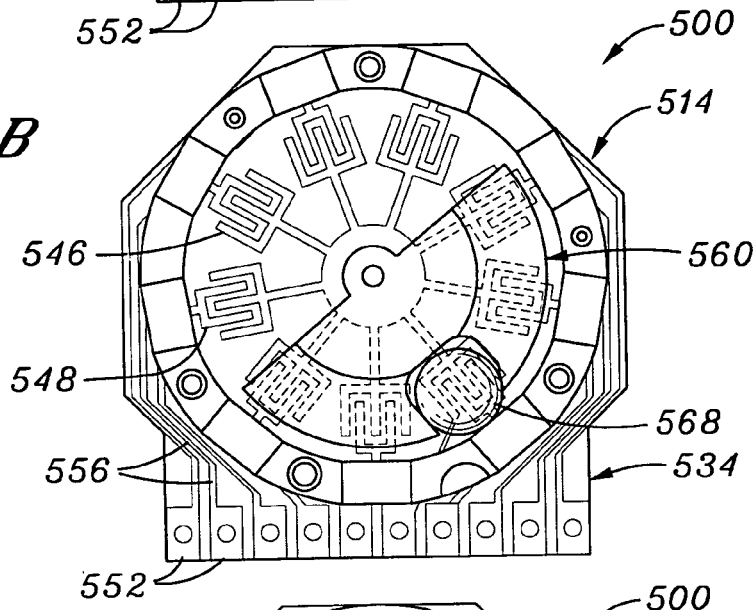
Figure 21A:
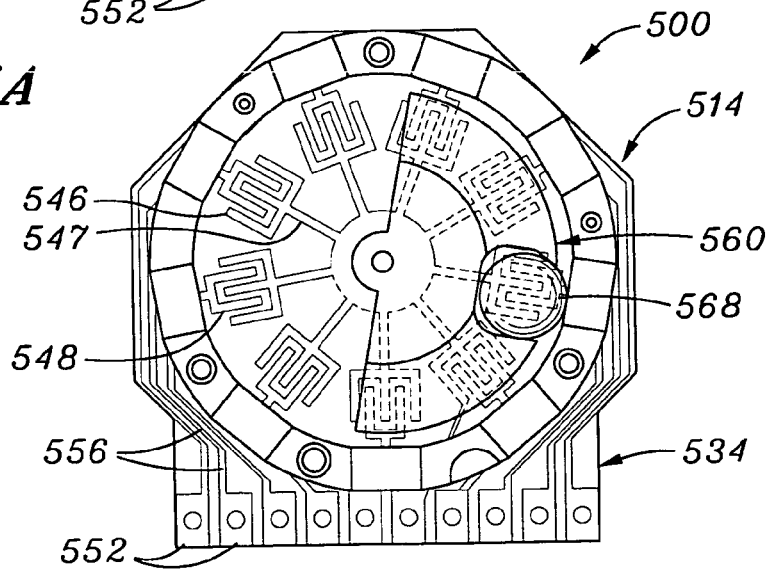

Referring now to FIGS. 21A, 21B, and 21C, the sensor 500 of the fifth embodiment itself has the capability of generating or producing a multiplicity of different states corresponding to respective positions of the sensor 500 relative to the reference plane. The movement of the sensor 500 relative to the reference plane facilitates the rotation of the trigger mechanism within the interior chamber of the housing 512. The sensor 500 is operative to generate a low state when the trigger ball 568 of the trigger mechanism is not in contact with any of the contact plates 517, and thus is not in contact with any of the intermeshed pairs of bottom inner and outer pads 546, 548 or top inner and outer pads 528, 529. The sensor 500 is further operative to generate nine different high states corresponding to contact between the trigger ball 568 and respective ones of the contact plates 517, examples of which are shown in FIGS. 21A, 21B, and 21C.

When the trigger ball 268 moves into contact with a contact plate 517, a closed circuit condition is created since there is a complete conductive path comprising one or both of the top and bottom pins 526, 544, the trigger plate 560, the trigger ball 568, the contact plate 517, one of the bottom peripheral pads 550 (due to the conductive contact between the bottom peripheral pads 550 and respective ones of the contact plates 517), one of the conductive traces 556, and one of the bottom output pads 552. The particular high state generated by the sensor 500 is dependent upon the contact plate 517 with which electrical contact is established by the trigger ball 568, i.e., each contact plate 517 produces a different high state when contacted by the trigger ball 568 due to each contact plate 517 being electrically connected to a respective, different bottom output pad 552 by a respective conductive trace 556.

As will be recognized, when the sensor 500 is disposed vertically relative to the reference plane (i.e., the top and bottom plates 518, 534 extend generally perpendicularly relative to the reference plane), the trigger ball 568 of the trigger mechanism may not be in contact with any of the intermeshed pairs of top inner and outer pads 528, 529 or bottom inner and outer pads 546, 548. Even in the absence of such contact, a particular high state may still be produced due to the conductive contact between the contact plates 517 and respective ones of the bottom peripheral pads 550 which are themselves electrically connected to respective ones of the bottom output pads 52 via respective ones of the traces 556.

When the sensor 500 is oriented such that the bottom plate 534 is disposed closer to the reference plane than the top plate 518, the trigger ball 568 will be shifted within the cavity 564 so as to directly contact the inner surface of the bottom plate 534. In this instance, when the trigger ball 568 is rotated into contact with any one of the contact plates 517, the trigger ball 568 will be in simultaneous conductive contact with the bottom inner and outer pads 546, 548 of the corresponding intermeshed pair. Thus, the bottom outer pads 548 provide redundancy to the contact plates 517 since, even if the trigger ball 568 does not achieve proper conductive contact with the contact plate 517, a closed circuit condition is still created by the complete conductive path comprising one or both of the top and bottom pins 526, 544, the trigger plate 560, the trigger ball 568, one of the bottom outer pads 548, one of the conductive traces 554, one of the bottom peripheral pads 550, one of the conductive traces 556, and one of the bottom output pads 552.

When the trigger ball 568 is in contact with any intermeshed pair of the bottom inner and outer pads 546, 548, a particular high state is generated by the sensor 500 which is indicative of the bottom plate 534 being disposed closer to the reference plane than the top plate 518 (i.e., the sensor 500 being disposed in a generally non-inverted orientation). This particular high state is generated as a result of the trigger ball 568 being in conductive contact with the bottom inner pad 546 and the resultant closed circuit condition created by the complete conductive path comprising one or both of the top and bottom pins 526, 544, the trigger plate 560, the trigger ball 568, two of the bottom inner pads 546, two of the conductive traces 547, the pad 542, the conductive trace 558, and one of the bottom output pads 552. However, if the trigger ball 568 rests upon the particular bottom inner pad 546 electrically connected to the bottom contact pad via the conductive trace 558, the conductive path does not include a second bottom inner pad 546 or a second conductive trace 547.

Conversely, when the sensor 500 is flipped over (i.e., turned upside-down) such that the top plate 518 is disposed closer to the reference plane than the bottom plate 534, the trigger ball 568 will be shifted within the cavity 564 so as to be brought into contact with the inner surface of the top plate 518. In this instance, the top outer pads 529 provide redundancy to the contact between the trigger ball 568 and the contact plates 517 in a similar manner to that described above since, even in the absence of conductive contact between the trigger ball 568 and a particular contact plate 517, a closed circuit condition is still created by the complete conductive path comprising one or both of the top and bottom pins 526, 544, the trigger plate 560, the trigger ball 568, one of the top outer pads 529, one of the conductive traces 533, one of the top peripheral pads 530, one of the contact plates 517, one of the bottom peripheral pads 550, one of the conductive traces 556, and one of the bottom output pads 552.

The particular high state generated by the sensor 500 when the trigger ball 568 is placed into conductive contact with any intermeshed pair of the top inner and outer pads 528, 529 is indicative of the sensor 500 being upside-down, i.e., the top plate 518 being disposed closer to the reference plane than the bottom plate 534. This particular high state is generated as a result of the closed circuit condition created by the complete conductive path comprising one or both of the top and bottom pins 526, 544, the trigger plate 560, the trigger ball 458, two of the top inner pads 528, the conductive trace 532 and the top output pad 531. The conductive path includes only one top inner pad 528 if the trigger ball 568 rests upon that top inner pad 528 in direct contact with that portion of the conductive trace 532 extending to the top output pad 531. The absence of any high states being generated which are indicative of either of the top or bottom plates 518, 534 being disposed closer to the reference plane is itself indicative of the sensor 500 being disposed in a general vertical orientation relative thereto, i.e., the top and bottom plates 518, 534 extending generally perpendicularly relative to the reference plane, as could result in the trigger ball 568 not being in conductive contact with any intermeshed pair of the top inner and outer pads 528, 529 or bottom inner and outer pads 546, 548.

Figure 30:
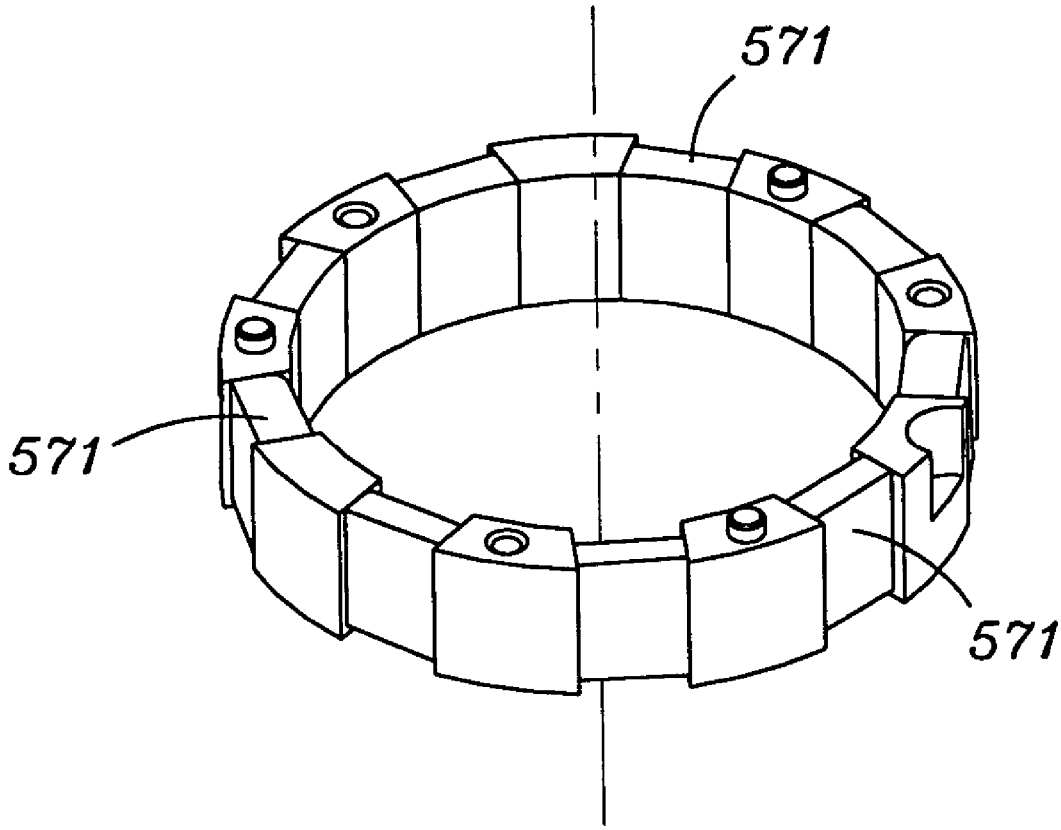
FIG. 30 is a top perspective view of an alternative side wall of the sensor housing which may be used in the sensors of the fifth and sixth embodiments of the present invention.

Referring now to FIG. 30, it is contemplated that as an alternative to the separate metallic contact plates 517 being attached to the side wall 514 at ninety degree intervals, a conductive coating may be applied to the side wall 514 in four sections 571 which each mimic the configuration of the contact plates 517. In this respect, a portion of each section 571 is disposed on the inner surface of the side wall 514, with other portions of each section 571 being disposed upon each of the top and bottom peripheral rims of the side wall 514.

Figure 27:
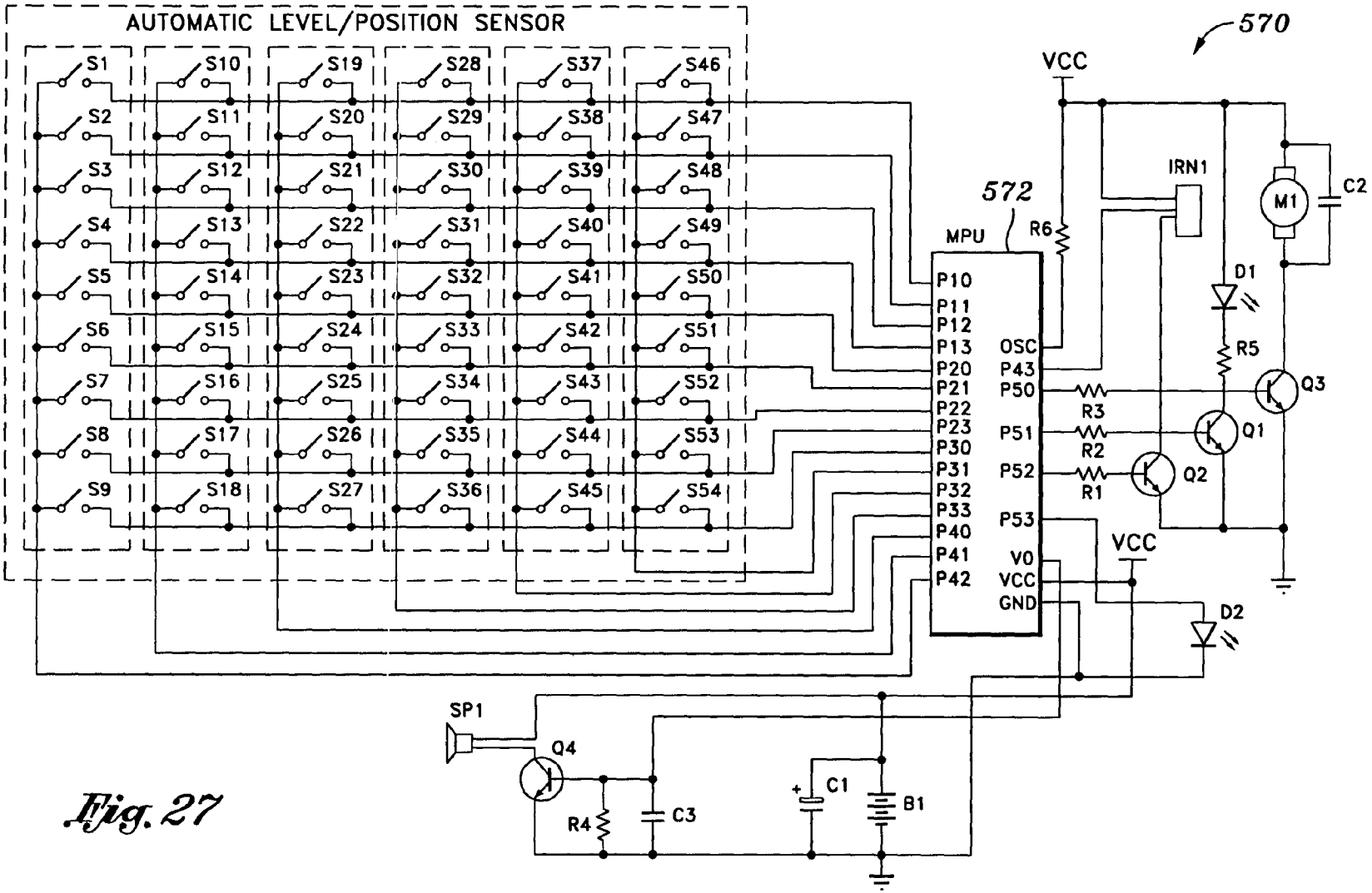
FIG. 27 is a schematic of electronic circuitry which may be used in conjunction with the sensor of certain embodiments of the present invention.

The sensor 500 of the fifth embodiment is preferably used in combination with programmable electronic circuitry 570 which is shown schematically in FIG. 27. The programmable electronic circuitry 570 used in conjunction with the sensor 500 is in electrical communication therewith, and has the same operative capabilities as the electronic circuitry 70 described above. The electronic circuitry 570 includes an MPU 572. The MPU 572 includes a total of fifteen input/output ports or i/o's which are labeled as P10–P13, P30–P33, and P40–P42. The bottom output pads 552 are electrically connected to respective ones of the i/o's of the MPU 572. Similarly, the top output pad 531 is electrically connected to a respective one of the i/o's. Thus, a total of eleven i/o's are used by the sensor 500. To facilitate the creation of the required conductive paths through the sensor 500, it is contemplated that one of the top and bottom pins 526, 544 will be in electrical communication with the electronic circuitry 570 is a manner permitting electrical current to be transmitted therefrom into the trigger mechanism. That one of the top and bottom pins 526,544 not used to facilitate the transmission of current to the trigger mechanism is preferably used to establish a common ground to the electronic circuitry 570.

Figure 22:
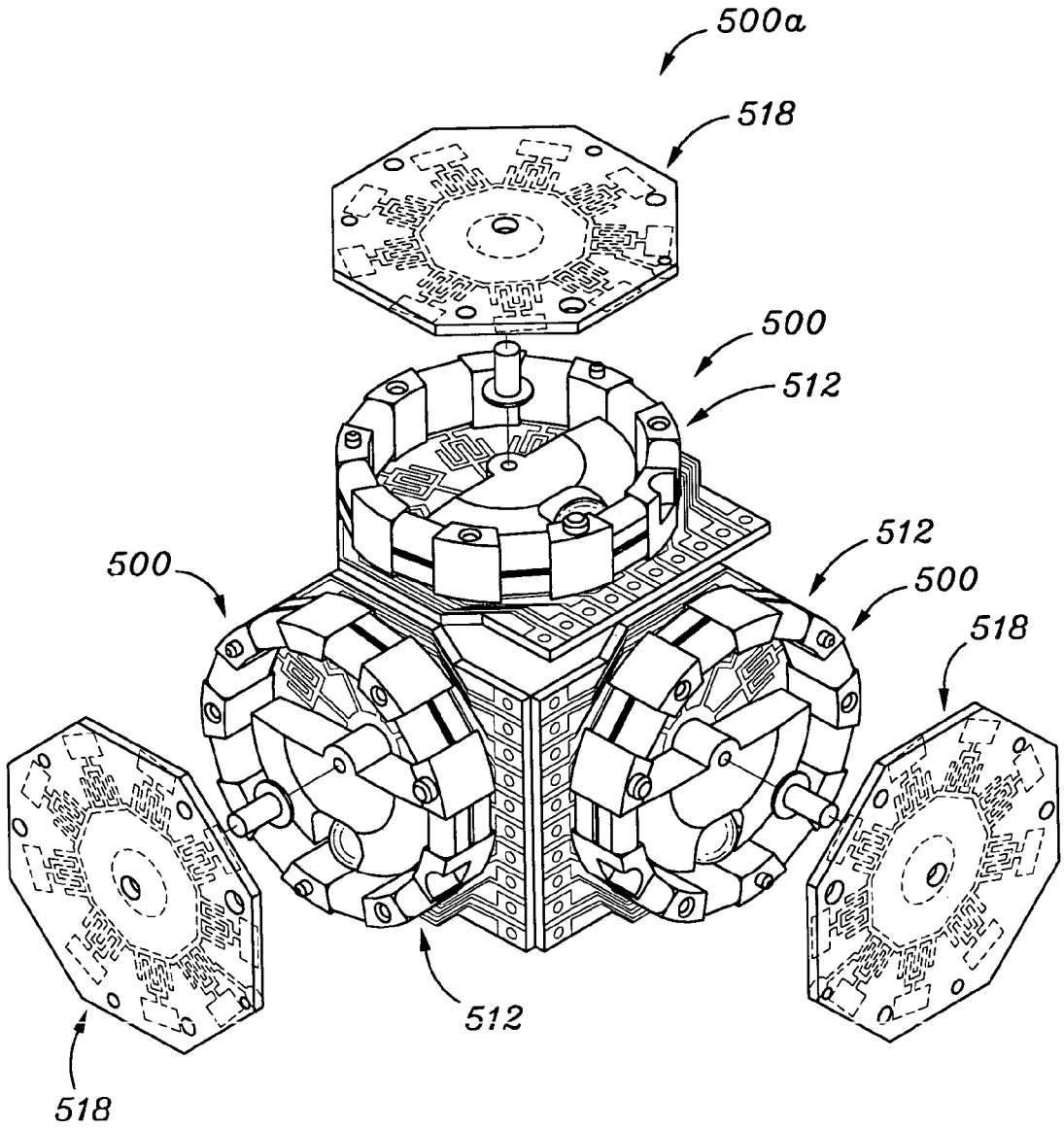
FIG. 22 is a perspective view of a multi-axis version of the sensor of the fifth embodiment, illustrating the top plates as separated from the remainder thereof.

Referring now to FIG. 22, there is depicted a sensor 500*a* which is a three-axis version of the sensor 500. In the sensor 500*a*, the housings 512 of three identically configured sensors 500 are attached to each other or to a common mount such that each corresponding pair of top and bottom pins 526, 544 is coaxially aligned with a respective one of three different axes which extend in generally perpendicular relation to each other. Each sensor 500 of the sensor 500*a* functions in the above-described manner. Since each sensor 500 is operative to generate a low state and ten different high states as described above, the sensor 500*a* would itself be operative to generate the low state and at least one thousand different high states (ten to the third power based on three axes) depending on the orientation thereof relative to the reference plane. The electronic circuitry used in conjunction with the sensor 500*a* would provide the same functionality as the electronic circuitry 570, i.e., differentiating and/or comparing states and/or conditions, and generating resultant effects.

Figure 23:
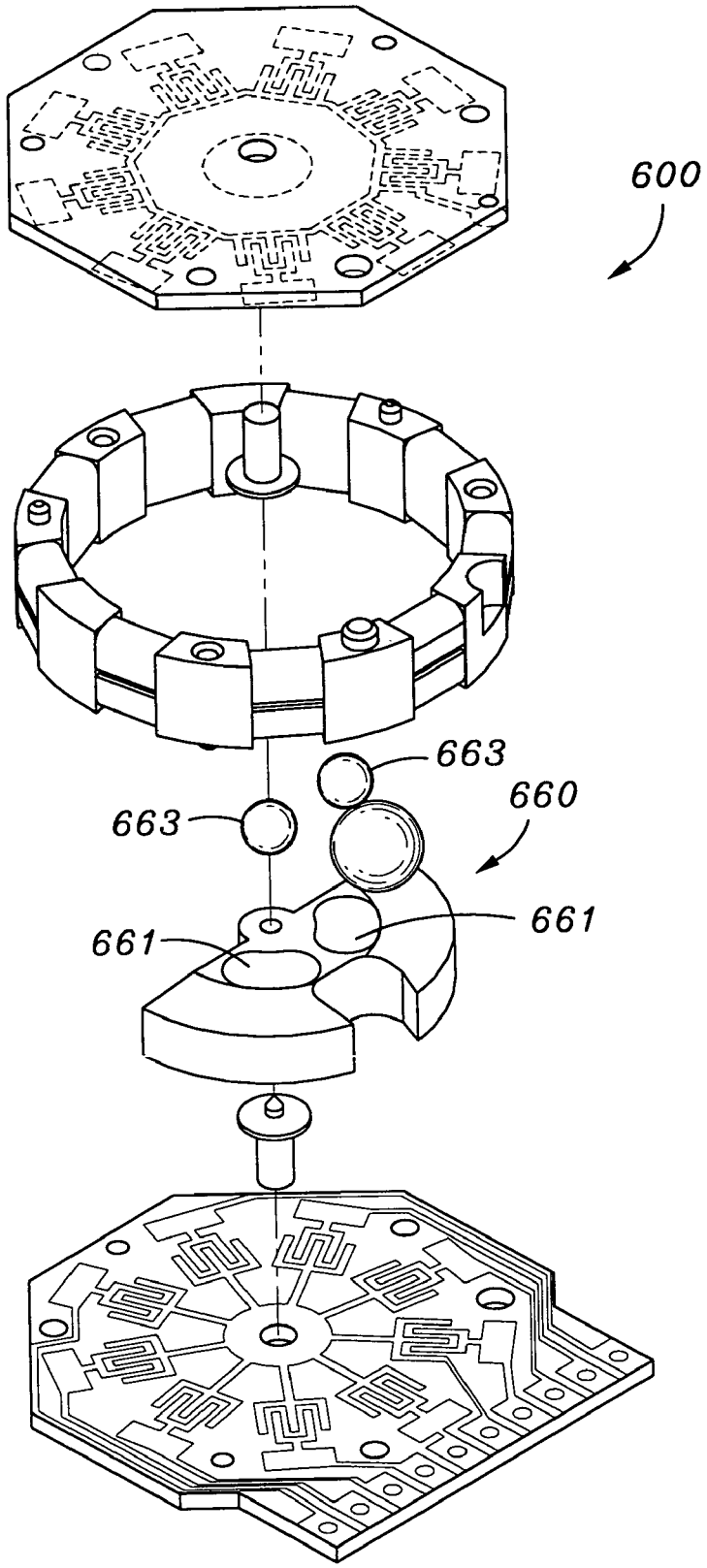
FIG. 23 is an exploded view of a sensor constructed in accordance with a sixth embodiment of the present invention.

Referring now to FIG. 23, there is depicted an exploded view of a sensor 600 constructed in accordance with a sixth embodiment of the present invention. The sensor 600 is identical both structurally and functionally to the sensor 500, with the sole exception lying in the structural attributes of the trigger plate 660. More particularly, the trigger plate 660 of the sensor 600 is identical to the trigger plate 560, except that the trigger plate 660 further includes a spaced pair of arcuately shaped slots 661 within the center section thereof. Disposed within each slot 661 is a spherically shaped slide ball 663. The slide balls 663 assist the rotation of the trigger plate 660 upon the movement of the sensor 600 relative to the reference plane.

Figure 24:
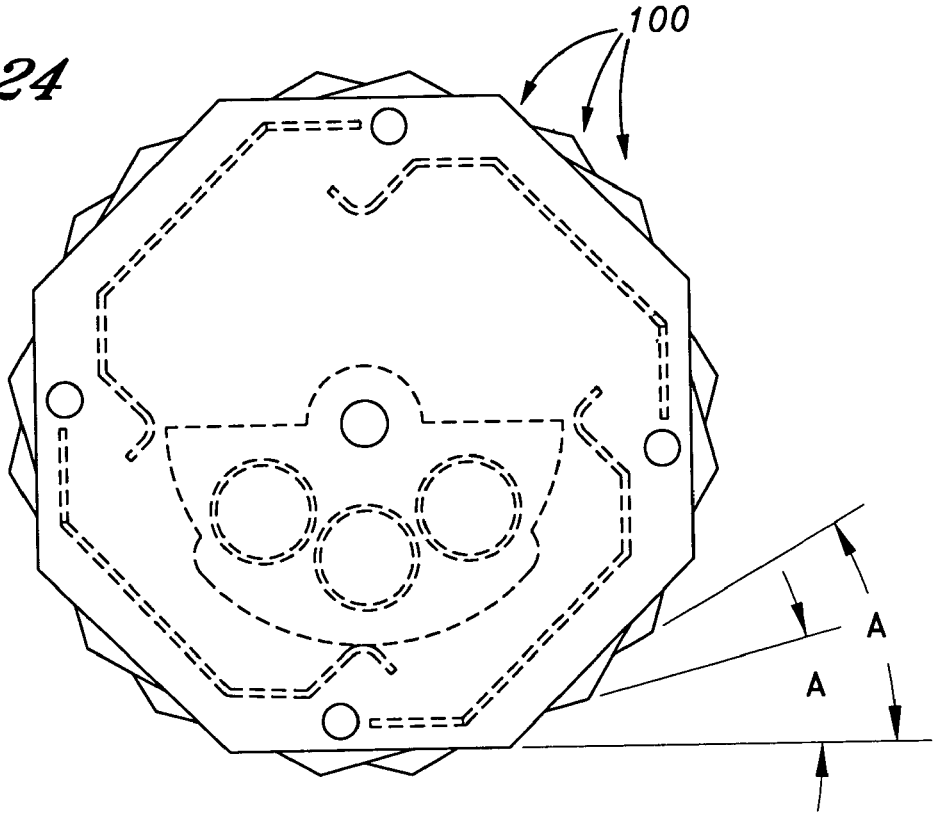
FIG. 24 is a top plan view of a stacked version of the sensor of the second embodiment.
Figure 25:
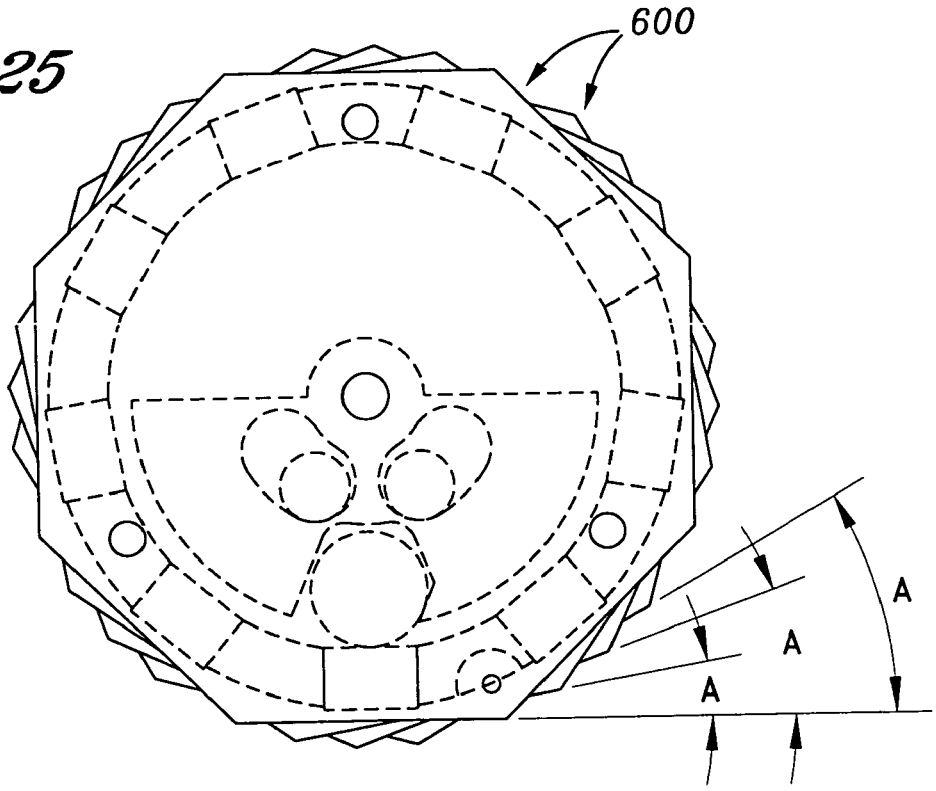
FIG. 25 is a top plan view of a stacked version of the sensor of the sixth embodiment.

Referring now to FIGS. 24 and 25, it is contemplated that the sensors of any embodiment of the present invention may be disposed in a stacked configuration and angularly offset relative to each other. For example, in FIG. 24, three of the sensors 100 of the second embodiment are shown as being stacked upon each other, with each sensor 100 being angularly offset relative to the sensor 100 immediately therebelow by a prescribed angle A. As a further example, in FIG. 25, four sensors 600 of the sixth embodiment are shown as being stacked upon each other, with each sensor 600 being angularly offset relative to the sensor 600 immediately therebelow by a prescribed angle A. As will be recognized, such angular offsetting allows for a dramatic increase in the number of states and hence the number of conditions which may be generated by the entirety of the stacked configuration. The electronic circuitry used in conjunction with such stacked sensors would have the capability of comparing/differentiating such states and conditions, and generating resultant effects.

It is contemplated that a sensor possessing the structural and functional attributes described above in relation to the various embodiments of the present invention may be used in conjunction with the infrared communication technology described in Applicant's U.S. Pat. No. 6,309,775 entitled INTERACTIVE TALKING DOLLS issued Oct. 30, 2001, the disclosure of which is expressly incorporated herein by reference. In this regard, interactive electronic toys, games or other devices into which the sensor of any embodiment of the present invention is incorporated may further be outfitted to include the communication system embodied in U.S. Pat. No. 6,309,275 to impart an even higher level of functionality thereto. More particularly, any embodiment of the sensor described above may be placed into electrical communication with such communication system to facilitate the transmission of signals between the toys or other interactive devices through the use of such communication system, the signals generated by the communication system potentially being correlated to those signals generated by the movement or actuation of the sensor.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A sensor for use in an interactive electronic device, the sensor comprising:

a housing having:

a side wall defining an inner surface;

a top plate attached to the side wall and defining an inner surface;

a bottom plate attached to the side wall and defining an inner surface;

the inner surfaces of the side wall and the top and bottom plates collectively defining an interior chamber;

at least one top pad disposed on the inner surface of the top plate;

at least one bottom pad disposed on the inner surface of the bottom plate;

at least one switch communicating with the interior chamber; and a trigger mechanism disposed within the interior chamber and rotatably connected to the housing, the trigger mechanism being sized and configured to selectively engage the top and bottom pads and the switch;

the sensor being operative to generate a plurality of different states corresponding to respective positions of the housing relative to a reference plane, the states being generated by the movement of the housing relative to the reference plane and the resultant contact between the trigger mechanism and at least one of the top pad, the bottom pad, and the switch.

2. The sensor of claim 1 further in combination with programmable electronic circuitry which is in electrical communication with the sensor and operative to translate at least some of the states generated by the sensor into respective effects.

3. The sensor of claim 2 wherein the electronic circuitry is programmed to compare at least two successive states generated by the sensor to each other.

4. The sensor of claim 3 wherein the electronic circuitry is further programmed to produce a selected effect upon successive states of a prescribed sequence being transmitted thereto from the sensor.

5. The sensor of claim 1 wherein the trigger mechanism comprises:

a trigger plate which is rotatably connected to the housing, the trigger plate including at least one aperture extending therethrough and defining an arcuate outer surface having at least one protuberance extending radially therefrom; and at least one trigger ball disposed within the aperture of the trigger plate;

the switch of the sensor being selectively engageable by the protuberance of the trigger plate, with each of the top and bottom pads of the sensor being selectively engageable by the trigger ball of the trigger mechanism.

6. The sensor of claim 5 wherein:

at least two top pads are disposed on the inner surface of the top plate;

at least two bottom pads are disposed on the inner surface of the bottom plate; and the trigger plate of the trigger mechanism is in electrical communication with one of the top pads and one of the bottom pads.

7. The sensor of claim 1 wherein the switch is in electrical communication with at least one of the top and bottom pads.

8. A sensor for use in an interactive electronic device, the sensor comprising:

a housing having:

a side wall defining an inner surface;

a top plate attached to the side wall and defining an inner surface;

a bottom plate attached to the side wall and defining an inner surface;

the inner surfaces of the side wall and the top and bottom plates collectively defining an interior chamber;

at least one top inner pad and at least one top outer pad disposed on the inner surface of the top plate in juxtaposed relation to each other;

at least one bottom inner pad and at least one bottom outer pad disposed on the inner surface of the bottom plate in juxtaposed relation to each other;

at least one switch communicating with the interior chamber; and a trigger mechanism disposed within the interior chamber and rotatably connected to the housing, the trigger mechanism being sized and configured to selectively engage the top and bottom inner and outer pads and the switch;

the sensor being operative to generate a plurality of different states corresponding to respective positions of the housing relative to a reference plane, the states being generated by the movement of the housing relative to the reference plane and the resultant contact between the trigger mechanism and at least one of the switch, the juxtaposed top inner and outer pads, and the juxtaposed bottom inner and outer pads.

9. The sensor of claim 8 further in combination with programmable electronic circuitry which is in electrical communication with the sensor and operative to translate at least some of the states generated by the sensor into respective effects.

10. The sensor of claim 9 wherein the electronic circuitry is programmed to compare at least two successive states generated by the sensor to each other.

11. The sensor of claim 10 wherein the electronic circuitry is further programmed to produce a selected effect upon successive states of a prescribed sequence being transmitted thereto from the sensor.

12. The sensor of claim 8 wherein the trigger mechanism comprises:

a trigger plate which is rotatably connected to the housing, the trigger plate defining an arcuate outer surface having at least one cavity formed therein; and at least one trigger ball disposed within the cavity of the trigger plate;

the switch of the sensor, the juxtaposed top inner and outer pads and the juxtaposed bottom inner and outer pads each being selectively engageable by the trigger ball of the trigger mechanism.

13. The sensor of claim 12 wherein:

at least two juxtaposed pairs of the top inner and outer pads are disposed on the inner surface of the top plate;

at least two juxtaposed pairs of the bottom inner and outer pads are disposed on the inner surface of the bottom plate; and the trigger plate of the trigger mechanism is in electrical communication with one of the top inner pads and one of the bottom inner pads.

14. The sensor of claim 8 wherein the switch is in electrical communication with at least one of the top and bottom outer pads.

15. The sensor of claim 8 wherein the trigger mechanism comprises:

a trigger plate which is rotatably connected to the housing, the trigger plate including at least one aperture extending therethrough and defining an arcuate outer surface having at least one protuberance extending radially therefrom; and at least one trigger ball disposed within the aperture of the trigger plate;

the switch of the sensor being selectively engageable by the protuberance of the trigger plate, with the juxtaposed pair of the top inner and outer pads and the juxtaposed pair of the bottom inner and outer pads each being selectively engageable by the trigger ball of the trigger mechanism.

16. The sensor of claim 15 wherein:

at least two juxtaposed pairs of the top inner and outer pads are disposed on the inner surface of the top plate;

at least two juxtaposed pairs of the bottom inner and outer pads are disposed on the inner surface of the bottom plate; and the trigger plate of the trigger mechanism is in electrical communication with one of the top inner pads and one of the bottom inner pads.

17. A sensor for use in an interactive electronic device, the sensor comprising:

at least two housings attached to each other, each of the housings having:

a side wall defining an inner surface;

a top plate attached to the side wall and defining an inner surface;

a bottom plate attached to the side wall and defining an inner surface;

the inner surfaces of the side wall and the top and bottom plates collectively defining an interior chamber;

at least one top pad disposed on the inner surface of the top plate of each of the housings;

at least one bottom pad disposed on the inner surface of the bottom plate of each of the housings;

at least one switch communicating with the interior chamber of each of the housings; and a trigger mechanism disposed within the interior chamber of each of the housings and rotatably connected thereto, each trigger mechanism being rotatable about a respective one of first and second axes which extend in generally perpendicular relation to each other, and sized and configured to selectively engage the top and bottom pads and the switch of a respective one of the housings;

the sensor being operative to generate a plurality of different states corresponding to respective positions of the housings relative to a reference plane, the states being generated by the movement of the housings relative to the reference plane and the resultant contact between the trigger mechanisms and at least one of the top pads, the bottom pads, and the switches.

18. The sensor of claim 17 comprising three housings attached to each other such that each trigger mechanism is rotatable about a respective one of first, second, and third axes which extend in generally perpendicular relation to each other.

19. The sensor of claim 17 further in combination with programmable electronic circuitry which is in electrical communication with the sensor and operative to translate at least some of the states generated by the sensor into respective effects.

20. The sensor of claim 19 wherein the electronic circuitry is programmed to compare at least two successive states generated by the sensor to each other.

* * * * *